US008525686B2

(12) United States Patent
Burdenko

(10) Patent No.: US 8,525,686 B2
(45) Date of Patent: Sep. 3, 2013

(54) VARIABLE ADJUSTABLE DOOR LATCH

(75) Inventor: Michael N. Burdenko, Wellesley Hills, MA (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 598 days.

(21) Appl. No.: 12/822,742

(22) Filed: Jun. 24, 2010

(65) Prior Publication Data

US 2011/0291848 A1 Dec. 1, 2011

Related U.S. Application Data

(63) Continuation-in-part of application No. 12/789,989, filed on May 28, 2010.

(51) Int. Cl.
*G08B 21/00* (2006.01)

(52) U.S. Cl.
USPC ..... 340/665; 340/545.7; 49/280; 49/340; 49/380; 292/251.5; 292/253

(58) Field of Classification Search
USPC ..... 340/665, 635, 540, 545.1, 545.6, 340/545.7; 49/28, 276, 280, 373, 380, 340, 49/344; 292/251.5, 253, 259, 341.18
See application file for complete search history.

(56) References Cited

U.S. PATENT DOCUMENTS 5,515,649 A * 5/1996 Strab ..... 49/280
5,605,364 A * 2/1997 Shelledy ..... 292/259 R
5,933,067 A 8/1999 Frolov
6,611,414 B1 8/2003 Lavelle et al.
7,205,872 B2 4/2007 Baechle et al.
7,856,760 B2 * 12/2010 Klingbyle ..... 49/380
2002/0196123 A1 12/2002 Diehl et al.
2003/0167693 A1 9/2003 Mainini
2003/0178857 A1 9/2003 Caspi et al.
2004/0245855 A1 12/2004 Bachle
2005/0108945 A1 5/2005 Wiemer et al.
2007/0096856 A1 5/2007 Wiemer et al.
2009/0288346 A1 11/2009 Esser

OTHER PUBLICATIONS

OA dated Oct. 10, 2012 for U.S. Appl. No. 12/789,989, 19 pages.
"Machine Guarding Safety Products," for Schmersal, GK-C Condensed Catalog, Jun. 2009, 12 pages.
Leaflet entitled "Sensor Technology PSEN" for PILZ, Apr. 2009, 74 pages.

(Continued)

*Primary Examiner* — Hung T. Nguyen
(74) *Attorney, Agent, or Firm* — Turocy & Watson, LLP; William R. Walbrun; John M. Miller

(57) ABSTRACT

Systems, methods, and devices that efficiently stop and latch a door are presented. A first bracket component is attached to a door frame and has an overhang portion, comprising a holder component, that extends into the doorway to act as a door stop. A second bracket component, comprising an extended portion, is desirably adjusted in position in relation to the holder component and attached to the door such that the extended portion has a desired amount of overlap on the holder component, wherein the amount of overlap corresponds to an amount of latching force in accordance with the force profile associated with the extended portion based at least in part on shape of the extended portion. An operation device is attached to the first bracket component and/or second bracket component and the door latching holds the door in the desired position to facilitate operations of the operation component.

17 Claims, 15 Drawing Sheets

(56) References Cited

OTHER PUBLICATIONS

News flyer entitled "PSENslock Safety Gate Systems—Now With 1000 N of Magnetic Force" for PILZ, Apr. 2009, 2 pages.

Operating Instructions for "PSENslock Safety Gate System," for PILZ, 21909-04, PSEN sl-1.0p-1.1/2.1/2.2/1.1 VA, May 2010, 15 pages.

* cited by examiner

VARIABLE ADJUSTABLE DOOR LATCH

CROSS-REFERENCE TO RELATED APPLICATION AND CLAIM FOR PRIORITY

This application is a continuation-in-part of and claims the benefit of co-pending U.S. patent application Ser. No. 12/789,989, filed on May 28, 2010, entitled "Efficient And Safe Door Locking Control In Power-Off And Power-On Conditions", the entirety of which is incorporated herein by reference.

TECHNICAL FIELD

The subject specification relates generally to door latches, and in particular to variable adjustable door latches.

BACKGROUND

Certain areas (e.g., rooms, secured production areas, etc.) can be accessed via a door (e.g., swinging door, sliding door, etc.), wherein, as desired, a particular defined physical area can be secured by employing a lock, a sensor, and/or other device on the door to the defined physical area. For example, an electromagnetic lock can be used to lock a door to a defined physical area, where the defined physical area can be used, for example, for storage of product, for production line operations, etc. Often, it can be desirable to be able to latch the door to hold the door in a desired position (e.g., closed position) in relation to the door frame, where, for example, the door can then be locked to facilitate securing the defined physical area.

One type of conventional door latch accomplishes latching of the door by using an electromagnet with variable current. Certain issues can arise when using such conventional door latches. For instance, such a conventional door latch consumes energy while producing the latching. Also, a loss of power creates a loss of latching by such door latch. Due in part to these drawbacks, such conventional door latches may not be suitable and/or may not be allowed in certain applications, such as some safety applications, for example. Another type of conventional door latch accomplishes latching of the door using a permanent magnet, wherein the magnet is integrated with the lock. With this type of conventional door latch, it is not possible to vary the latching conditions without degrading the locking quality of the lock (e.g., safety lock). Also, some conventional door latches are integrated with door stops, wherein such door latches may allow for some adjustment. However, such conventional door latches do not allow for adjustment of the door latch while at the same time allowing for predictable and desirable force profile settings.

It is desirable to be able to hold or latch a door in a desired locational position (e.g., closed position) in relation to a door frame with a desired amount of force without consuming power to produce the force, while, for example, a safety switch or safety lock associated with the door is activated, and at the same time, providing a stop for the door. It also is desirable to be able to intelligently adjust the amount of latching force used to hold the door in the desired locational position. It is further desirable to reduce or minimize shock to a device, such as a lock, sensor, or switch, attached to the door frame (or door), during closing of the door, to facilitate reducing or minimizing harm to or operational problems with such device.

SUMMARY

The following discloses a simplified summary of the specification in order to provide a basic understanding of some aspects of the specification. This summary is not an extensive overview of the specification. It is intended to neither identify key or critical elements of the specification nor delineate the scope of the specification. Its sole purpose is to disclose some concepts of the specification in a simplified form as a prelude to the more detailed description that is disclosed later.

Systems, methods, and devices that can efficiently employ a power efficient door latch/door stop arrangement are presented. In an aspect, a door latch/door stop system can comprise a first bracket component (e.g., door frame bracket component) that can be attached to a door frame, and a second bracket component (e.g., door bracket component) that can be attached to a door (e.g., swinging door, sliding door, etc.) associated with the door frame. In an aspect, the first bracket component and/or second bracket component can be made from a desired material(s), such as a ferromagnetic material(s), which can be attracted to a magnetic force when applied thereto, although accordance with other embodiments, another desired material(s) can be employed. The first bracket component can be have a desired shape (e.g., rectangular, square, etc.) and size, wherein, for example, the first bracket component can be desirably attached to the door frame and be large enough in size such that a desired portion of the first bracket component can overhang beyond the door frame and into the doorway so that the first bracket component can be employed, in part, as a door stop and door latching mechanism for the door, which can be associated with (e.g., attached to a side of, in the sliding groove of) the door frame, when the door is being closed.

In an aspect, the second bracket component can be shaped (e.g., substantially rectangular or square shaped with regard to the main body of the second bracket component) and sized, as desired, wherein there can be an extended portion (e.g., tongue, tag) that can extend out from the main body of the second bracket component, and wherein the extended portion can be employed to facilitate stopping and latching of the associated door, for example, when the extended portion comes in contact with a holder component (e.g., magnet component) associated with the first bracket component, as more fully disclosed herein.

The system can further comprise one or more holder components, which can be attached or adhered to a recessed area(s), for example, at or near an edge of the first bracket component. In an embodiment, a holder component can be or can include, for example, a permanent magnet that can produce at least a desired amount of force (e.g., magnetic force) to facilitate attracting and holding the extended portion of the second bracket component against the holder component to thereby hold or latch the door in a desired predefined locational position (e.g., a specified location) in relation to the door frame when the door is closed. The predefined locational position can be a desired locational position in relation to an operation device (e.g., lock, such as an electromagnetic lock; a sensor; a switch; etc.), which can be attached to the first bracket component and/or second bracket component.

In accordance another embodiment, the holder component, when contained on the first bracket component, can comprise a vacuum cup that can apply a desired amount of force to a surface (e.g., extended portion) of the second bracket component (or conversely, the first bracket component (e.g., in the recessed area), when the holder component is contained on the second bracket component) (e.g., via the vacuum or suction force generated by applying the vacuum cup to a surface of the second bracket component) to latch or hold the door in the desired locational position. In still another embodiment, the holder component can be a Velcro liner, which can be attached to the first or second bracket component, wherein a Velcro receptor can be attached to the other of the first or second bracket component, and the Velcro liner can come in contact with the Velcro receptor when the door is closed such that a desired amount of latching force is created by the Velcro liner being attached to the Velcro receptor to hold the door in the desired locational position.

As an example of the door stopping/door latching system, the operation device can be an electromagnetic lock, wherein the lock component, which can include the lock pin (e.g., lock bolt) and solenoid actuator, can be attached to the first bracket component (e.g., on the portion of the first bracket component that overhangs beyond the door frame), and a lock receptacle, which can have a hole that can receive the lock pin to the lock the door, when desired, can be attached to the second bracket component. When closing and locking the door, the overhanging portion of the first bracket component can act as a door stop for the door, so that the door stops when it comes in contact with the overhanging portion of the first bracket component, and the extended portion of the second bracket component comes in contact with the holder component, wherein the magnetic force of the holder component can hold or latch the extended portion to thereby latch the door and hold the door closed in the desired predefined locational position. The predefined location position can be selected such that, when the door is in that position, the lock pin of the lock component and the hole in the lock receptacle can be desirably aligned in relation to each other so that when the lock component is switched to the locked state, the lock pin can engage or be inserted in the hole in the lock receptacle to lock the door with respect to the door frame.

In accordance with an aspect, the amount of latching force applied by the holder component to the extended portion of the second bracket component can be controlled and varied based at least in part on the amount of overlap of the extended portion on the surface of the holder component there is when the door is in the latched position (e.g., when at least a portion of the extended portion is in contact with the surface of the holder component). As desired, the extended portion can be adjusted or moved in relation to the holder component associated with the first bracket component to facilitate adjusting the amount of latching force the holder component applies to the extended portion. The second bracket component can have extended or substantially rectangular or oblong screw guides (e.g., holes wherein a screw(s) can be inserted to attach the second bracket component to the door), wherein the second bracket component, including the extended portion, can be moved along the screw guides to adjust the amount of overlap the extended portion has on the holder component in the closed position until the extended portion has a desired amount of overlap with the holder component to result in the desired amount of latching force in the closed position, wherein the screws can be tightened to the door to attach the second bracket component to the door at the point along the screw guides that results in the desired amount of overlap of the extended portion on the holder component.

In another aspect, the extended portion of the second bracket component can be shaped and sized as desired to facilitate creating or adjusting the force profile of the extended portion and the system overall. For instance, the extended portion can be respectively shaped to have a force profile that is linear (or substantially linear) or non-linear with regard to adjusting the latching force based at least in part on adjustments of the amount of overlap of the extended portion in relation to the holder component. For example, when the extended portion has a rectangular or square shape, the force profile can be linear or at least substantially linear, such that, as the extended portion is moved in a direction resulting is less overlap with the holder component, there can be a linear or substantially linear reduction in the amount of latching force applied by the holder component to the extended portion, and, as the extended portion is moved in a direction resulting is more overlap with the holder component, there can be a linear or substantially linear increase in the amount of latching force applied by the holder component to the extended portion. As another example, instead of a rectangular or square shaped extended portion, the extended portion can have one edge or corner (or both edges or corners) rounded, or can be shaped in a triangular shape, which can create a non-linear force profile, such that, as the extended portion is moved in a direction resulting is less overlap with the holder component, there can be a non-linear (e.g., square function, exponential function, etc.) reduction in the amount of latching force applied by the holder component to the extended portion, and, as the extended portion is moved in a direction resulting is more overlap with the holder component, there can be a non-linear increase in the amount of latching force applied by the holder component to the extended portion, wherein the non-linear force profile can be based at least in part on the particular shape of the extended portion and the amount of overlap of extended portion on the holder component.

In yet another aspect, the second bracket component can include, or can have adhered thereon (e.g., using a suitable adhesive material), a force level guide that can show the respective amounts of latching force that can be achieved at respective positions of the extended portion of the second bracket component in relation to the holder component associated with the first bracket component. The force level guide can comprise a set of force level lines or grooves that each has a respective force level associated with that particular line or groove (e.g., first line indicates 10 Newtons (N), second line indicates 20 N, third line indicates 30 N, etc.). When the second bracket component is adjusted or moved about its screw guides to adjust the amount of overlap of the extended portion in relation to the holder component, the force level guide can indicate the amount of latching force that corresponds with the position of the second bracket component in relation to the holder component and/or associated operation device. The user can view the amount of latching force indicated on the force level guide so the user can be informed as to the amount of latching force and can adjust the second bracket component, and thereby the amount of latching force, to achieve the desired amount of latching force. The respective levels indicated by the force level guide and the placement of the corresponding force level lines or grooves can be determined based at least in part on the shape of the extended portion and the magnetic force of the holder component. In accordance with various embodiments, the force level guide can be formed on the second bracket component, wherein, for example, force level lines can be formed in or on a surface of the second bracket component (e.g., surface facing outward when attached to the door; or the force level guide can be formed on a force level plate, which can be formed of metal, polymer-based material, paper, or other desired material, and can be attached or adhered to the surface of the second bracket component).

In still another aspect, the first bracket component can function as a shock or force absorber for an operation device attached to the first bracket component. For instance, the first bracket component, with the overhanging portion that overhangs beyond the door frame, can function as a type of cantilever, wherein the material that forms the first bracket component can have at least some level of elasticity, and when the door impacts and is stopped by the overhanging portion of the first bracket component, the first bracket component can absorb at least a portion of the impact of the door, which can reduce the amount of shock, vibration, or force that is impacted on (e.g., transferred to) the operation device. In an embodiment, if desired, a shock absorber component, which can be fabricated from a desired material(s) (e.g., polymer-based material, felt, etc.) and can have a desired thickness and shape (e.g., shape that corresponds to the shape of the surface of the overhanging portion with which the shock absorber component will be in contact and/or the shape of the side of the operation device with which the shock absorber component will be in contact), can be inserted between the first bracket component and the operation device to provide further shock or force absorption to thereby further reduce the amount of shock, vibration, or force impacted on the operation device when the door impacts (e.g., comes in contact with) the overhanging portion of the first bracket component when the door is being closed.

In yet another aspect, the system can comprise an operation integrity component that can sense conditions associated with the first bracket component and second bracket component, the door and associated door frame, and/or operation devices attached to the first bracket component or second bracket component to facilitate securing the door and associated defined physical area, as desired, and maintaining desirable operation of the system. In an embodiment, the operation integrity component can be associated with a sensor component (e.g., magnetic field sensor, which can be or can comprise a Reed switch or Hall-effect sensor, in accordance with various embodiments) that can be associated with (e.g., connected to, implanted in) the recessed area of the first bracket component (or, in another embodiment, in the extended portion of the second bracket component) and can sense whether recessed area (or the extended portion) is in a magnetized state or non-magnetized state and/or sense the amount of magnetic field or force applied to recessed area (or the extended portion) by the holder component, wherein, for example, the holder component can be attached to the extended portion and can apply a desired latching force to the recessed area (or another component formed thereon or attached thereto), or alternatively, can be attached to the recessed area and can apply a desired latching force to the extended portion. When the door is open, the sensor component can sense that the amount of magnetic force applied to or experienced by the recessed area (or the extended portion) is low (e.g., below a minimum threshold magnetic force level that indicates the door is properly closed) and can transmit a signal (e.g., feedback signal) that indicates the door is in an open state. When the door is closed properly, the sensor component can sense that the amount of magnetic force applied to or experienced by the recessed portion (or the extended portion) is at least the minimum threshold latching force level and can transmit a signal that indicates the door is in a closed state. The feedback signal can serve as a Magnetic Bond Sensor (MBS) output as well as a Door Status Switch (DSS) for the door latch. The sensor component can be useful, for example, when a lock component with a lock pin is attached to the first bracket component and a lock receptacle is attached to the second bracket component, as the sensor component can indicate when the second bracket component and associated lock receptacle are in the desired predefined locational position in relation to the lock pin associated with the first bracket component, so that when the lock pin is moved to the locked position, the lock pin can successfully engage the hole in the lock receptacle.

Also, over time and/or for other reasons, the door may become misaligned, and, as a result, which can cause misalignment of the recessed area (or the extended portion) in relation to the holder component, and also can cause misalignment of the lock pin in relation to the hole in the lock receptacle, which can negatively affect operations associated with the door (e.g., door is unable to be locked because the lock pin is not able to engage the hole in the lock receptacle). The misalignment of the recessed area (or the extended portion) in relation to the holder component can result in a change in the strength of the magnetic field. The sensor component can detect the magnetic field strength at or on the recessed area (or the extended portion), and can send feedback relating to the detected magnetic field strength, for example, to a computer system. The computer system can analyze the feedback information and can identify that the magnetic field strength has changed to an undesirable level, and can determine that the door is misaligned or at least is likely misaligned, or that the recessed area (or the extended portion) is not in proper alignment with the holder component, and a maintenance ticket can be issued to have a maintenance person check out the door and the door latch/door stop system and correct any defect so that the system operates properly.

The following description and the annexed drawings set forth certain illustrative aspects of the specification. These aspects are indicative, however, of but a few of the various ways in which the principles of the specification can be employed. Other advantages and novel features of the specification will become apparent from the following detailed description of the specification when considered in conjunction with the drawings.

DETAILED DESCRIPTION

Figure 1:
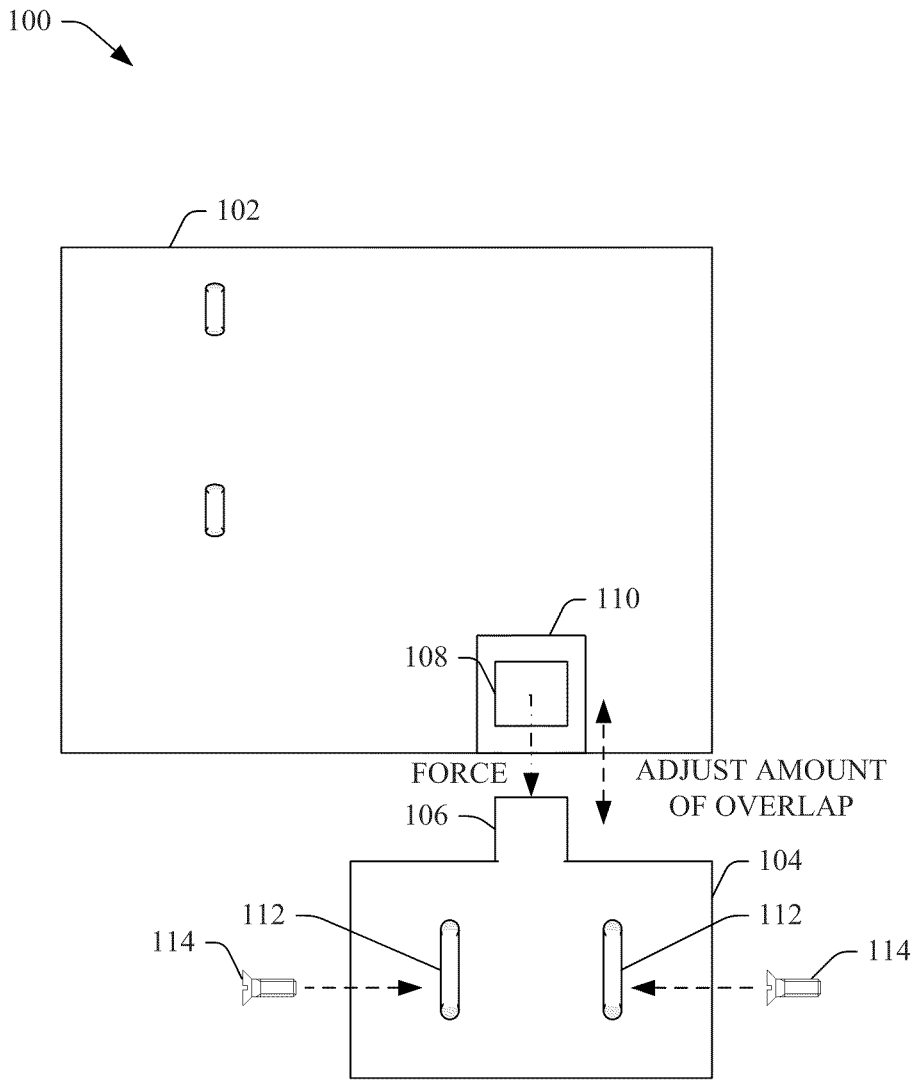
FIG. 1 illustrates a diagram of an example system that can efficiently stop and latch a door in accordance with various aspects and embodiments of the disclosed subject matter.

The disclosed subject matter is now described with reference to the drawings, wherein like reference numerals are used to refer to like elements throughout. In the following description, for purposes of explanation, numerous specific details are set forth in order to provide a thorough understanding of the disclosed subject matter. It can be evident, however, that the disclosed subject matter can be practiced without these specific details. In other instances, well-known structures and devices are shown in block diagram form in order to facilitate describing the disclosed subject matter.

As used in this application, the terms "component," "module," "object", "system," or the like can refer to hardware (e.g., lock housing, lock pin, magnet, etc.) and/or a computer-related entity, either hardware, a combination of hardware and software, software, or software in execution. For example, a component can be, but is not limited to being, a process running on a processor, a processor, an object, an executable, a thread of execution, a program, and/or a computer. By way of illustration, both an application running on a controller and the controller can be a component. One or more components can reside within a process and/or thread of execution and a component can be localized on one computer and/or distributed between two or more computers. As another example, an interface can include I/O components as well as associated processor, application, and/or API components.

Typically, operation devices, such as door locks, can be employed to secure doors and defined physical areas associated with the doors. Often, it can be desirable to be able to latch the door to hold the door in a specified position (e.g., a predefined locational position when closed) in relation to the door frame, where, for example, the door can then be locked, to facilitate securing the defined physical area. One type of conventional door latch accomplishes latching of the door by using an electromagnet with variable current. Certain issues can arise when using such conventional door latches, as for example, such a door latch consumes energy while producing the latching and loss of power creates a loss of latching. Due in part to these drawbacks, such conventional door latches may not be suitable and/or may not be allowed in certain applications, such as some safety applications, for example. Another type of conventional door latch accomplishes latching of the door using a permanent magnet, wherein the magnet is integrated with the lock. With this type of conventional door latch, it is not possible to vary the latching conditions without degrading the locking quality of the lock. Also, some conventional door latches are integrated with door stops, wherein such door latches may allow for some adjustment. However, such conventional door latches do not allow for adjustment of the door latch while at the same time allowing for predictable and desirable force profile settings.

To that end, systems, methods, and devices that efficiently stop and latch a door are presented. In an aspect, a first bracket component can be attached to a door frame and can have an overhang portion, comprising a holder component (e.g., permanent magnet), that can extend into the doorway to act as a door stop when the door is moved from the open position to the closed position in relation to the associated door frame. In another aspect, the second bracket component, which can comprise an extended portion (e.g., tongue, tag), can be desirably adjusted in position in relation to the holder component and attached to the door such that the extended portion has a desired amount of overlap on the holder component, wherein the amount of overlap can correspond to an amount of latching force (e.g., magnetic force) between the holder component and the extended portion in accordance with the force profile associated with the extended portion and based at least in part on the shape of the extended portion, wherein differently shaped extended portions can have different force profiles. In an embodiment, the holder component, by employing a permanent magnet to apply a desired amount of magnetic force to the extended portion (e.g., to magnetically attract and hold the extended portion), can desirably maintain latching without requiring power to thereby conserve power and maintain latching during power off conditions associated with the door. In still another aspect, an operation device (e.g., electromagnetic lock, sensor, switch, etc.) can be attached to the first bracket component (e.g., electromagnetic lock, comprising a solenoid actuator and lock pin, can be attached to the first bracket component) and/or second bracket component (e.g., lock receptacle associated with the lock can be attached to the second bracket component) and the door latching can hold the door in the desired predefined locational position to facilitate operations of the operation component.

Figure 3:
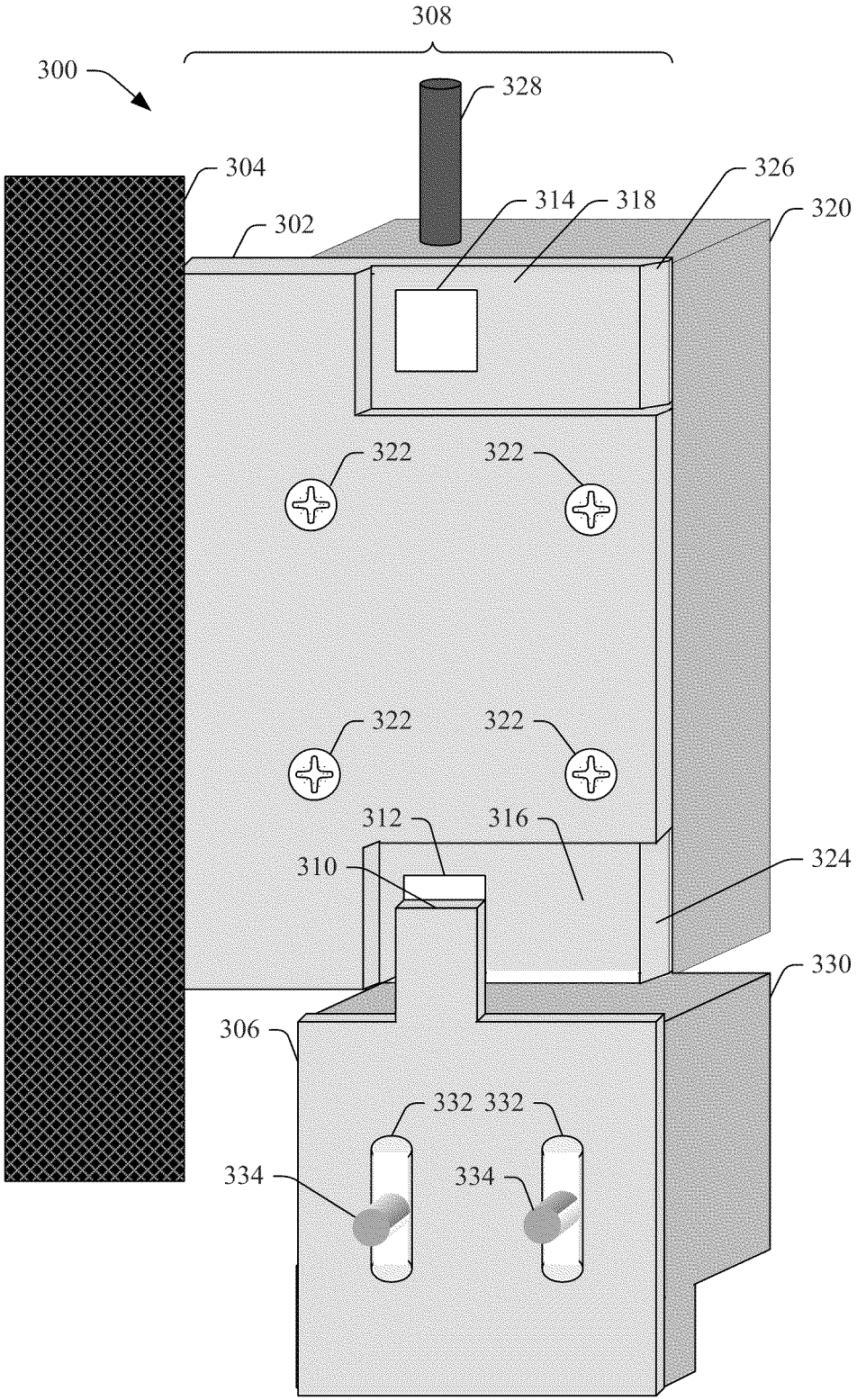
FIG. 3 illustrates a diagram of an example system that can efficiently stop and latch a door in accordance with an embodiment of the disclosed subject matter.
Figure 5A:
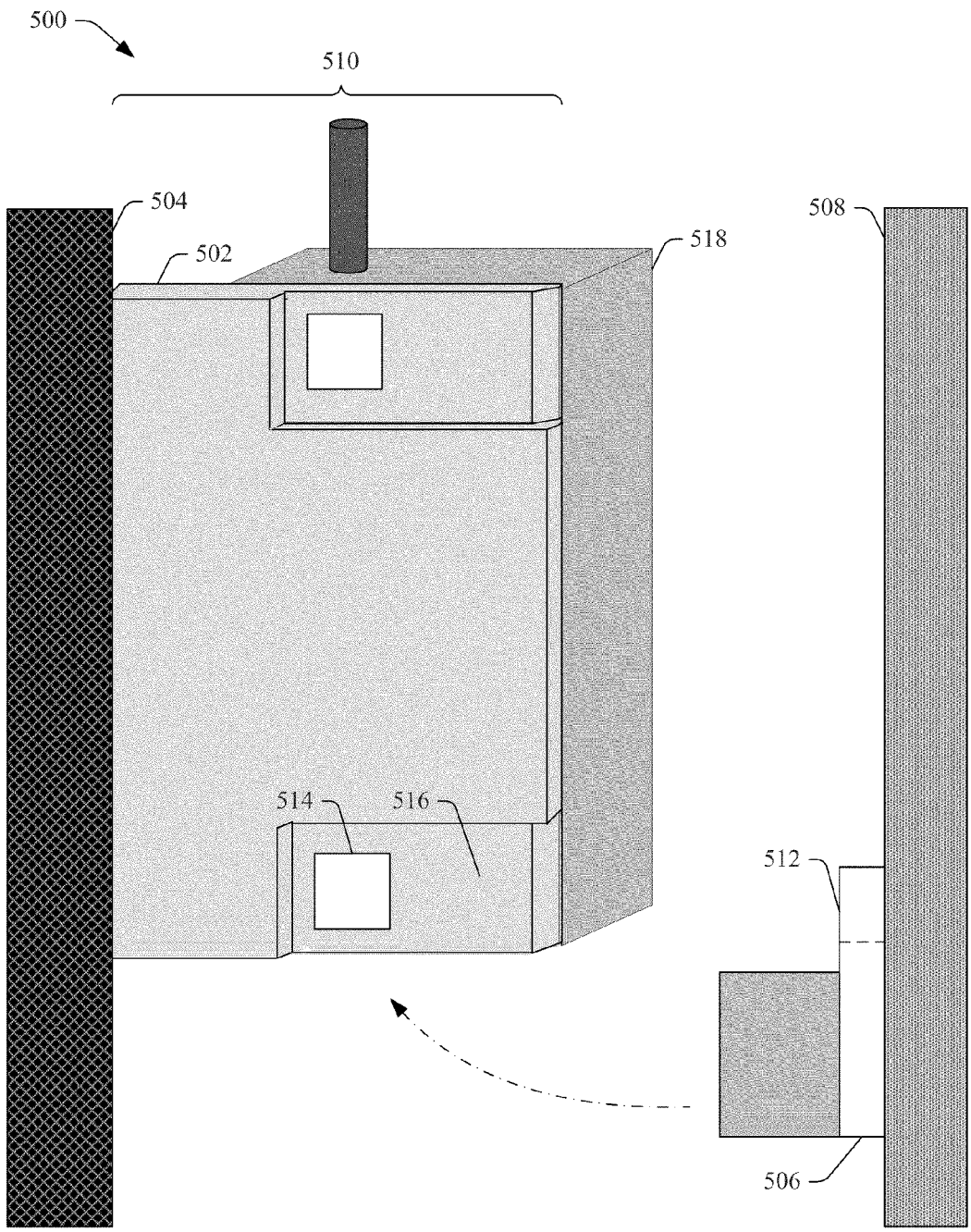
FIGS. 5A and 5B illustrate diagrams of example systems that each can facilitate reducing an amount of impact on an operation device due to closing of a door in accordance with various embodiments of the disclosed subject matter.
Figure 5B:
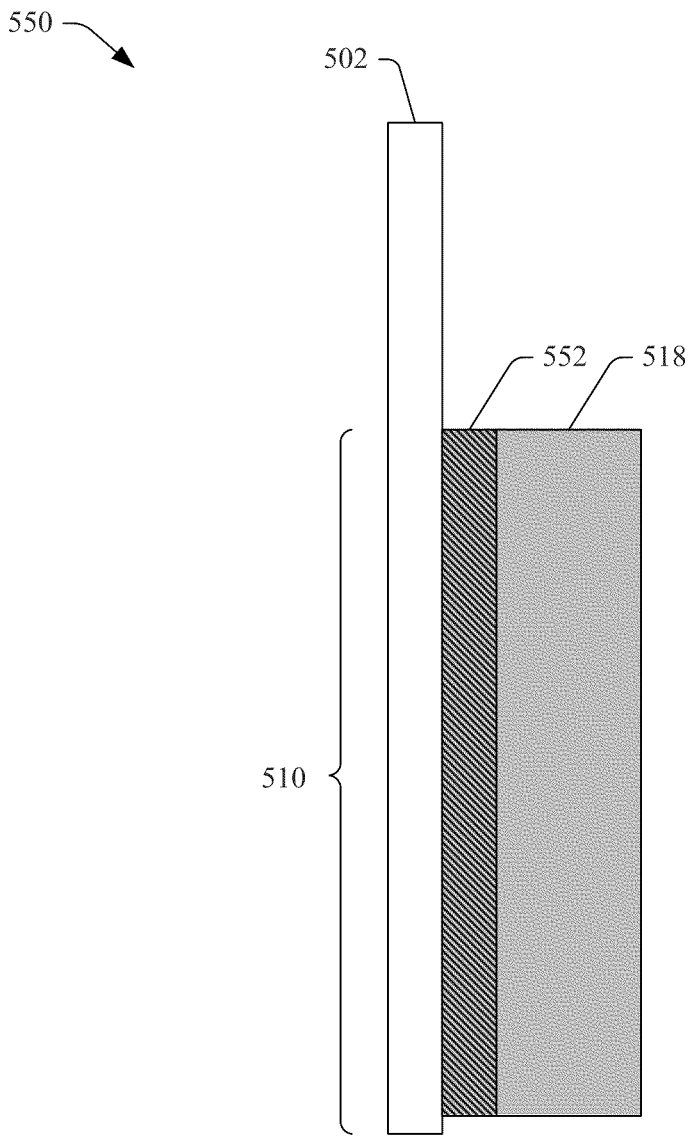

Now referring to FIG. 1, illustrated is a diagram of an example system 100 that can efficiently stop and latch a door in accordance with various aspects and embodiments of the disclosed subject matter. In an aspect, the system 100 (e.g., a door latch/door stop system) can comprise a first bracket component 102 (e.g., door frame bracket component) that can be attached to a portion of a door frame (not shown in FIG. 1; e.g., as shown in FIGS. 3, 5A, and 5B) at a desired location on the door frame. The system 100 also can include a second bracket component 104 (e.g., door bracket component) that can be attached to a door (e.g., swinging door, sliding door, etc.) (not shown in FIG. 1; e.g., as shown in FIG. 5A) associated with the door frame. In an aspect, the first bracket component 102 and/or second bracket component 104 can be made from a desired material(s), such as a ferromagnetic material(s), which can be attracted to a magnetic force when a magnetic force is applied thereto. The first bracket component 102 can be have a desired shape (e.g., rectangular, square, etc.) and size, wherein, for example, the first bracket component 102 can be large enough in size such that a portion of the first bracket component 102 can be desirably attached to the door frame and a desired portion of the first bracket component 102 can overhang and/or extend beyond the door frame and into the doorway so that the first bracket component 102 can be employed, in part, as a door stop and door latching mechanism for the door, which can be associated with (e.g., attached to a side of, in the sliding groove of) the door frame, when the door is being closed. That is, when the door is being closed, the door can come in contact with the overhanging portion of the first bracket component 102 and the first bracket component 102 can stop the door at that point.

In an aspect, the second bracket component 104 can be shaped (e.g., substantially rectangular or square shaped with regard to the main body of the second bracket component 104) and sized, as desired, wherein there can be an extended portion 106 (e.g., tongue, tag) that can extend out from the main body of the second bracket component 104. The extended portion 106 can be employed to facilitate stopping and latching of the associated door, for example, when the extended portion 106 comes in contact with a holder component 108 (e.g., magnet component) associated with the first bracket component 102, as more fully disclosed herein.

It is to be appreciated and understood that, while the subject specification generally discloses that the first bracket component 102 is attached to a door frame and the second bracket component 104 is attached to a door, the subject specification is not so limited, as, in accordance with another embodiment, the first bracket component 102 can be attached to the door and the second bracket component 104 can be attached to a door frame.

The system 100 can further comprise one or more holder components 108, which can be attached or adhered to a recessed area(s) 110, for example, at or near an edge of the first bracket component 102. In an embodiment, a holder component 108 can be or can include, for example, a permanent magnet that can produce at least a desired amount of force (e.g., magnetic force) to facilitate attracting and holding the extended portion 106 of the second bracket component 104 against the holder component 108 to thereby hold or latch the door in a desired predefined locational position (e.g., a specified location) in relation to the door frame when the door is closed. By employing a holder component 108 that comprises a permanent magnet to apply the desired force to latch the door, the system 100 does not have to use external power to maintain latching of the door, which can eliminate power consumption with regard to door latching (e.g., the system 100 can be desirably "green" or eco-friendly).

It is to be appreciated and understood though that, while the holder component is often described herein as comprising a magnet, such as a permanent magnet, the subject specification is not so limited, as in accordance with various embodiments of the disclosed subject matter, the holder component can comprise other components or features that can facilitate applying a desired latching force to hold the door in the desired locational position when the door is closed. In accordance with an embodiment, a holder component 108 alternatively can comprise an electromagnet that can receive power to generate an electromagnetic force to be applied to the extended portion 106 to facilitate the door latching. With regard to the door latching, the predefined locational position can be a desired locational position in relation to an operation device (e.g., lock, such as an electromagnetic lock; a sensor; a switch; etc.) (not shown in FIG. 1; e.g., as shown in FIGS. 3 and 5A), which can be attached to the first bracket component 102 (e.g., electromagnetic lock, comprising a solenoid actuator and lock pin can be attached to the first bracket component 102) and/or second bracket component 104 (e.g., a lock receptacle that is part of or associated with the electromagnetic lock can be attached to the second bracket component 104).

In accordance with another embodiment, the holder component 108, when contained on the first bracket component 102, can comprise a vacuum cup(s) that can apply a desired amount of force to the extended portion 106 of the second bracket component 104 (or conversely, to the surface in the recessed area 110 of the first bracket component 102, when the holder component 108 is contained on the second bracket component 104) (e.g., via the vacuum or suction force generated by applying the vacuum cup to the extended portion 106 of the second bracket component 104) to latch or hold the door in the desired locational position. In an aspect, multiple vacuum cups can be employed wherein the amount of latching force applied can be based at least in part on the amount of overlap of the holder component 108 has on the surface (e.g., extended portion 106), wherein the amount of overlap can determine the number of vacuum cups that are in contact with the surface when the door is in the closed position (e.g., the more vacuum cups in contact with the surface, the higher the latching force).

In still another embodiment, the holder component 108 can be or can comprise a Velcro liner, which can be attached to the first bracket component 102 or the extended portion 106 of the second bracket component 104, wherein a Velcro receptor can be attached to the other of the first bracket component 102 (e.g., in the recessed area 110) or the extended portion 106 of the second bracket component 104, and the Velcro liner can come in contact with the Velcro receptor when the door is closed such that a desired amount of latching force is created by the Velcro liner being attached to the Velcro receptor to hold the door in the desired locational position. In an aspect, the amount of latching force created by the Velcro liner can be based at least in part on the amount of overlap of the Velcro liner on the Velcro receptor, wherein more overlap can result in a higher latching force and less overlap can result in a lower latching force. The vacuum cup latching feature and the Velcro liner latching feature each can desirably latch the door without consuming or requiring power to generate and apply the desired amount of latching force.

In accordance with an aspect, the amount of latching force applied by the holder component 108 to the extended portion 106 of the second bracket component 104 can be controlled and varied (e.g., increased, decreased) based at least in part on the amount of overlap of the extended portion 106 on the surface of the holder component 108 when the door is in the latched position (e.g., when at least a portion of the extended portion 106 is in contact with the surface of the holder component 108). As desired, the extended portion 106 can be adjusted or moved in relation to the holder component 108 associated with the first bracket component 102 to facilitate adjusting the amount of overlap and thereby the amount of latching force the holder component 108 applies to the extended portion 106 when the associated door is in the closed position with respect to the door frame.

To facilitate adjusting the amount of overlap of the extended portion 106 on the surface of the holder component 108, the second bracket component 104 can have extended or substantially rectangular or oblong screw guides 112 (e.g., holes wherein a screw(s) 114 can be inserted to attach the second bracket component 104 (and/or an associated component of an operation device) to the door). The second bracket component 104, including the extended portion 106, can be moved along the screw guides 112 (e.g., slits) to adjust the amount of overlap the extended portion 106 has with regard to the surface of the holder component 108 when in the closed position until the extended portion 106 has a desired amount of overlap with the holder component 108 to result in the desired amount of latching force when in the closed position, wherein the screws 114 can be tightened to the door to attach the second bracket component 104 to the door at the point along the screw guides 112 that results in the desired amount of overlap of the extended portion 106 on the surface of the holder component 108. It can be desirable to be able to adjust the amount of latching force because, for example, different doors can have different weights or different door movement resistances, which can affect the amount of latching force that is desired for a particular door (e.g., it can be desirable to have a lower amount of latching force on a lighter door with a light amount of door movement resistance than on a heavier door and/or a door with heavier door movement resistance, for reasons of safety, for example (e.g., a higher latching force can quickly be reduced as the amount of space between the holder component and extended portion increases, which can result in a light door with a light amount of door level resistance suddenly breaking away when the latching force is overcome and the door can then potentially hit and/or injure the user who is opening the door), and/or there can be other factors that make is desirable to adjust the amount of latching force.

Figure 6:
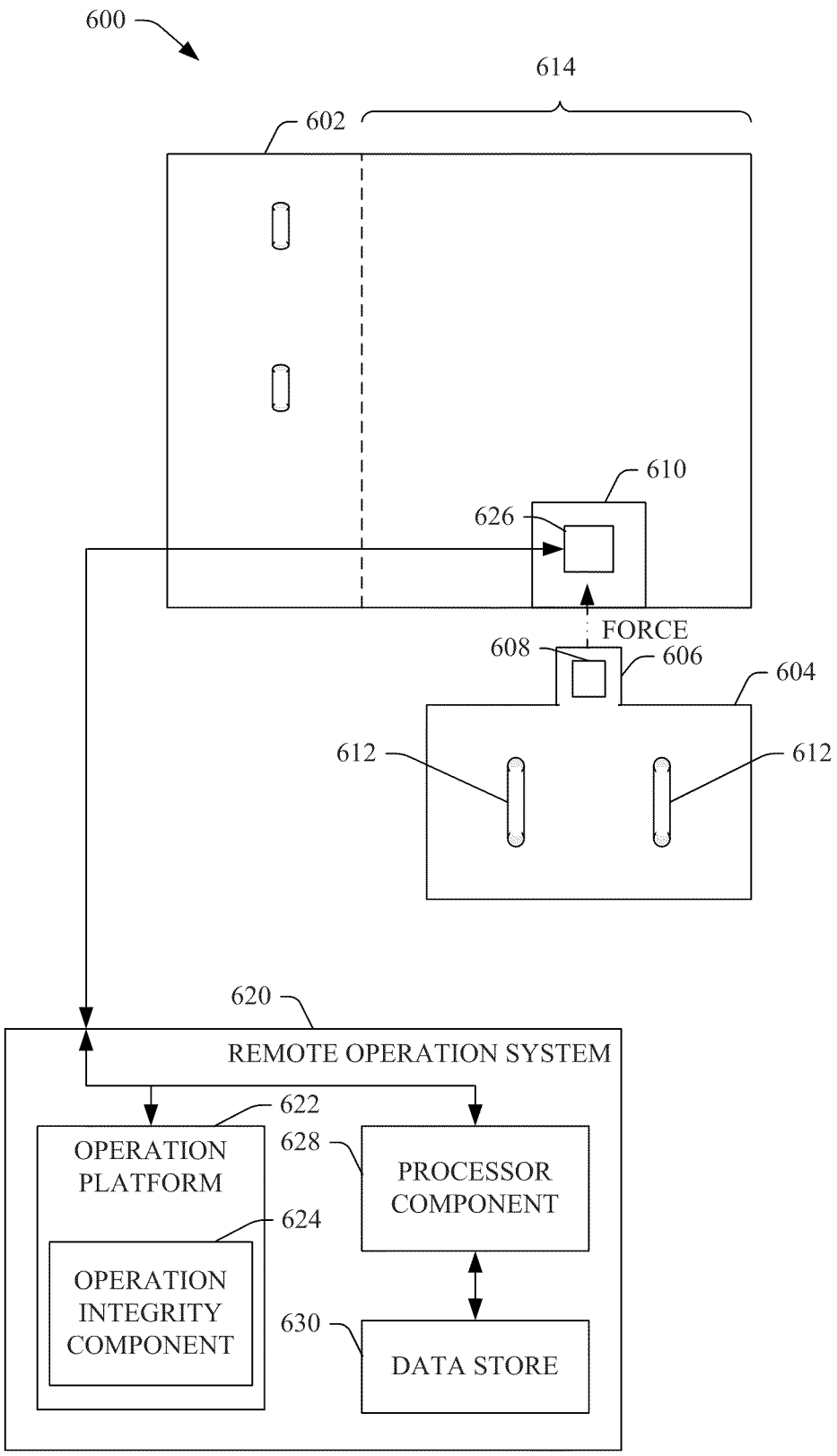
FIG. 6 illustrates a diagram of an example system that can facilitate monitoring integrity of the door latch/door stop system to facilitate system security and maintenance in accordance with an embodiment of the disclosed subject matter.

It is to be appreciated and understood that, while the subject specification generally discloses that the holder component 108 is inserted or attached to a recessed area 110 of the first bracket component 102 and the extended portion 106 is formed of a ferromagnetic material that can be attracted to the force applied by the holder component 108, the subject specification is not so limited, as, in accordance with another embodiment, the holder component 108 can be attached to the extended portion 106 and a portion of the recessed area 110 can be formed of a ferromagnetic material that can be attracted to the force applied on it by the holder component 108 (e.g., as depicted in FIG. 6 and described herein).

In accordance with various embodiments, the force profile of a latching system can be adjusted or set based at least in part on the shape of the extended portion of the second bracket component. Referring briefly to FIGS. 2A, 2B, 2C, and 2D, FIG. 2A depicts a portion of a system 200 that can employ a second bracket component having a substantially rectangular extended portion to facilitate door latching in accordance with an embodiment of the disclosed subject matter; FIG. 2B depicts a portion of a system 220 that can employ a second bracket component having an extended portion that is partially rounded to facilitate adjusting the force profile to facilitate desired door latching in accordance with another embodiment of the disclosed subject matter; FIG. 2C depicts a portion of a system 240 that can employ a second bracket component comprising an extended portion that is rounded on its top end to facilitate adjusting the force profile to facilitate desired door latching in accordance with yet another embodiment of the disclosed subject matter; and FIG. 2D depicts a portion of a system 260 that can employ a second bracket component comprising an extended portion that is shaped in the form of a triangle to facilitate adjusting the force profile to facilitate desired door latching in accordance with still another embodiment of the disclosed subject matter.

Figure 2A:
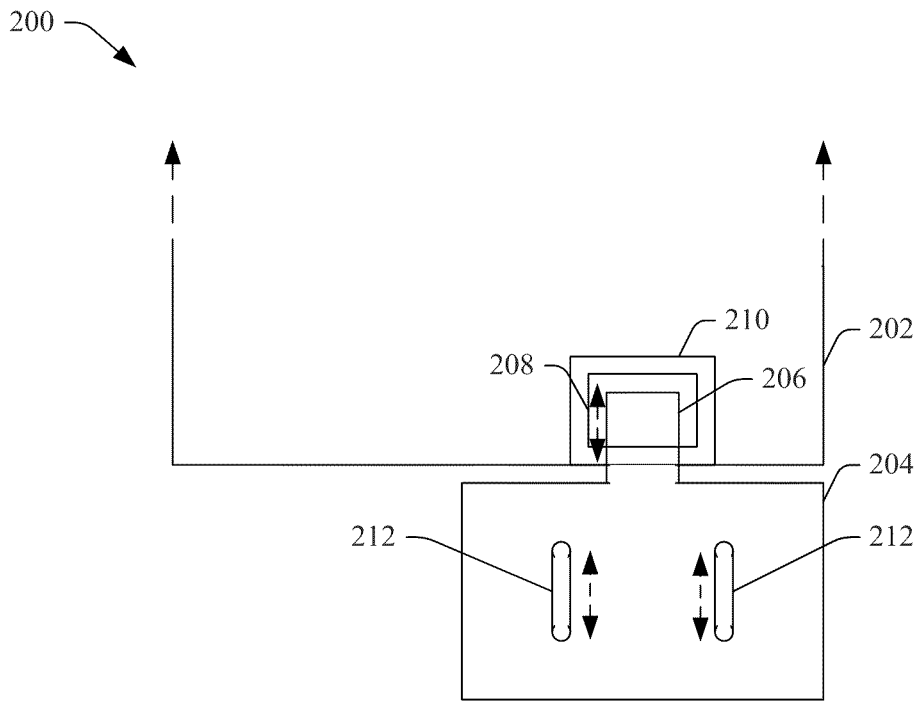
FIGS. 2A, 2B, 2C, and 2D respectively illustrate diagrams of respective example systems that can employ respective second bracket components comprising respective extended portions having respective shapes to facilitate obtaining respective force profiles relating to door latching in accordance with various embodiments of the disclosed subject matter.
Figure 2B:
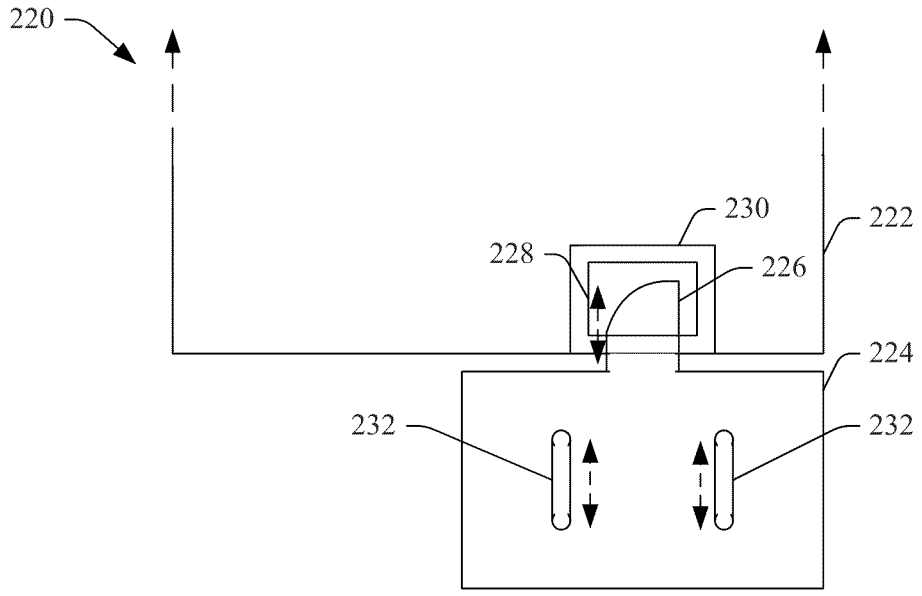
Figure 2C:
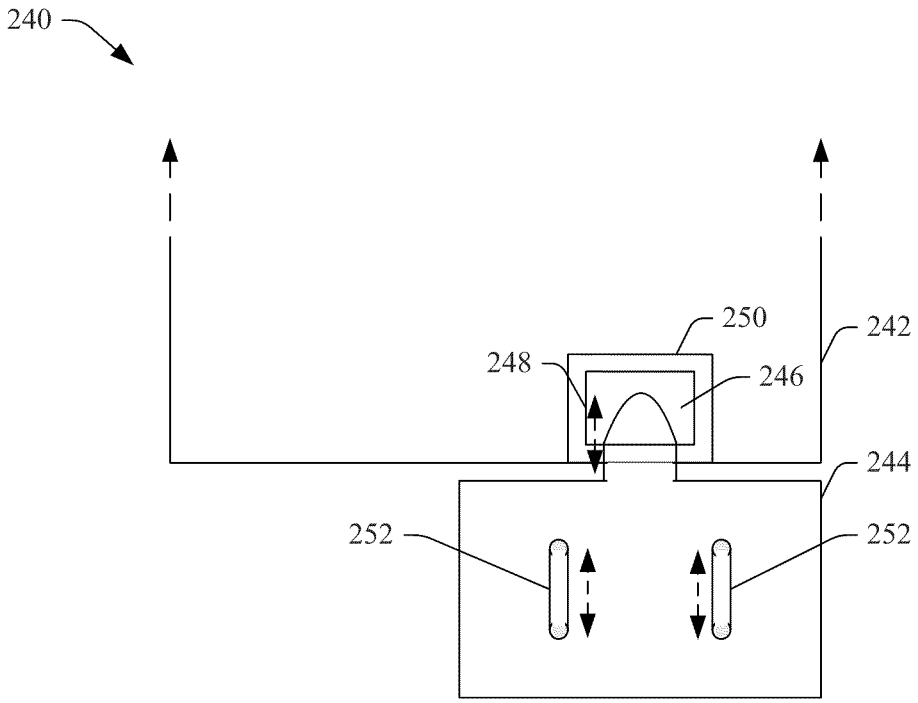
Figure 2D:
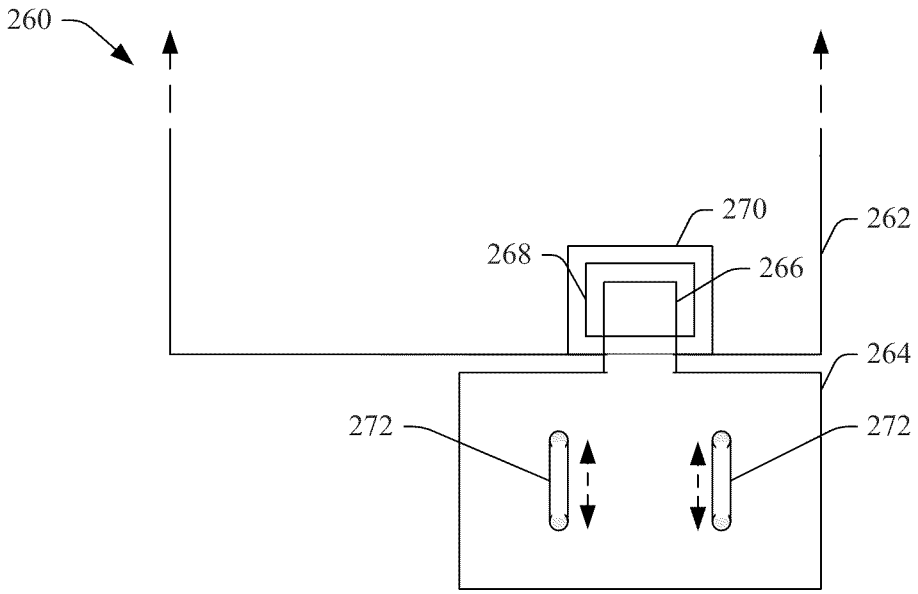

With regard to FIG. 2A, the portion of the system 200 can include a first bracket component 202 that can be attached to a door frame (not shown in FIG. 2A) and can be employed as a door stop and to facilitate latching the door (not shown in FIG. 2A) when the door is in the closed position in relation to the door frame. The system 200 can include a second bracket component 204 that can be attached to the door, for example, to facilitate latching of the door when the door is closed in relation to a door frame to which the door can be attached or can otherwise be associated. The second bracket component 204 can have an extended portion 206, which can be formed of a ferromagnetic material(s) (e.g., a material that can be magnetically attracted to a magnetic force or electromagnetic force), and can be employed to facilitate latching the door when the door is in the closed position, wherein the first bracket component 202 can comprise a holder component 208, which can include a permanent magnet that can produce a specified amount of magnetic force, and the holder component 208 can be inserted and/or adhered to a recessed area 210 formed in the first bracket component 202 in a region of the first bracket component 202 that can be aligned with the extended portion 206 of the second bracket component 204. The size of the recessed area 210 can be such that a desired portion of the extended portion 206 can be placed inside the recessed area 210. The holder component 208 can apply a desired amount of magnetic force to the extended portion 206 to hold the associated door in the closed position when the extended portion 206, or desired portion thereof, is in contact with the holder component 208, in accordance with the force profile associated with the extended portion 206, wherein the force profile can be based at least in part on the shape of the extended portion 206.

In this embodiment, the extended portion 206 can be shaped in the form of a rectangular shape, or a substantially rectangular shape, which can give the extended portion 206 a linear or substantially linear force profile. As a result, when the second bracket component 204 is adjusted in position in relation to the first bracket component 202 by moving the second bracket component 204 along its screw guides 212 the amount of force that can be applied to the extended portion 206 by the holder component 208 when the door is in the closed position can increase linearly or substantially linearly as the amount of overlap of the extended portion 206 on the holder component 208 increases, and can decrease linearly or substantially linearly as the amount of overlap of the extended portion 206 on the holder component 208 decreases.

FIG. 2B illustrates the portion of the system 220, which can include a first bracket component 222 that can be attached to a door frame (not shown in FIG. 2B) and can be employed as a door stop and to facilitate latching the door (not shown in FIG. 2B) when the door is in the closed position in relation to the door frame. The system 220 can include a second bracket component 224 that can be attached to the door, for example, to facilitate latching of the door when the door is closed in relation to a door frame to which the door can be attached or can otherwise be associated. The second bracket component 224 can have an extended portion 226, which can be formed of a ferromagnetic material(s), and can employed to facilitate latching the door when the door is in the closed position, wherein the first bracket component 222 can comprise a holder component 228, which can include a permanent magnet that can produce a specified amount of magnetic force, and the holder component 228 can be inserted and/or adhered to a recessed area 230 formed in the first bracket component 222 in a region of the first bracket component 222 that can be aligned with the extended portion 226 of the second bracket component 224. The size of the recessed area 230 can be such that a desired portion of the extended portion 226 can be placed inside the recessed area 230. The holder component 228 can apply a desired amount of magnetic force to the extended portion 226 to hold the associated door in the closed position when the extended portion 226, or desired portion thereof, is in contact with the holder component 228 in accordance with the force profile associated with the extended portion 226.

In accordance with this embodiment, the extended portion 226 can be shaped such that it is rounded on one side so as to form a quarter portion of a circle or an oval, which can give the extended portion 226 a specified non-linear force profile. As a result, when the second bracket component 224 is adjusted in position in relation to the first bracket component 222 by moving the second bracket component 224 along its screw guides 232 the amount of force that can be applied to the extended portion 226 by the holder component 228 when the door is in the closed position can increase non-linearly as the amount of overlap of the extended portion 226 on the holder component 228 increases (e.g., the rate of increase in magnetic force can vary (e.g., increase) as the amount of overlap increases), and can decrease non-linearly as the amount of overlap of the extended portion 226 on the holder component 228 decreases (e.g., the rate of decrease in magnetic force can vary (e.g., increase) as the amount of overlap decreases). As a further result, in comparison to the extended portion 206 of FIG. 2A, the increase in force experienced by (e.g., applied to) the extended portion 226 can be at a relatively slower rate than the increase in force experienced by the extended portion 206 in FIG. 2A as the second bracket component is moved to increase overlap of the extended portion 226 on the holder component 228, and the overall amount of force (e.g., latching force) that can be experienced by the extended portion 226 (e.g., when there is maximum overlap of the extended portion 226 on the holder component 228) will be less than the overall amount of force that can be applied to or experienced by the extended portion 206 (e.g., when there is maximum overlap of the extended portion 206 on the holder component 208), since the extended portion 206 can have more overlap on the holder component than the extended portion 226.

Turning to FIG. 2C, illustrated is the portion of system 240, which can include a first bracket component 242 that can be attached to a door frame (not shown in FIG. 2C) and can be employed as a door stop and to facilitate latching the door (not shown in FIG. 2C) when the door is in the closed position in relation to the door frame. The system 240 can include a second bracket component 244 that can be attached to the door, for example, to facilitate latching of the door when the door is closed in relation to a door frame to which the door can be attached or can otherwise be associated. The second bracket component 244 can have an extended portion 246, which can be formed of a ferromagnetic material(s), and can employed to facilitate latching the door when in the closed position, wherein the first bracket component 242 can comprise a holder component 248, which can include a permanent magnet that can produce a specified amount of magnetic force, and the holder component 248 can be inserted and/or adhered to a recessed area 250 formed in the first bracket component 242 in a region of the first bracket component 242 that can be aligned with the extended portion 246 of the second bracket component 244. The size of the recessed area 250 can be such that a desired portion of the extended portion 246 can be placed inside the recessed area 250. The holder component 248 can apply a desired amount of magnetic force to the extended portion 246 to hold the associated door in the closed position when the extended portion 246, or desired portion thereof, is in contact with the holder component 248, in accordance with the force profile associated with the extended portion 246.

In this embodiment, the extended portion 246 can be shaped such that it is rounded on both ends of the top side so as to form a semi-circle or semi-oval on the top end of the extended portion 246, which can give the extended portion 246 a non-linear force profile. As a result, when the second bracket component 244 is adjusted in position in relation to the first bracket component 242 by moving the second bracket component 244 along its screw guides 252 to increase or decrease overlap of the extended portion 246 on the holder component 248, the amount of force that can be applied to the extended portion 246 by the holder component 248 when the door is in the closed position can increase non-linearly as the amount of overlap of the extended portion 246 on the holder component 228 increases (e.g., the rate of increase in the amount of magnetic force can vary (e.g., increase) as the amount of overlap increases), and can decrease non-linearly as the amount of overlap of the extended portion 246 on the holder component 248 decreases (e.g., the rate of decrease in the amount of magnetic force can vary (e.g., increase) as the amount of overlap decreases), wherein the force profile associated with the extended portion 246 can be different than the force profile associated with the extended portion 226, even though both force profiles are non-linear. As a further result, in comparison to the extended portion 206 of FIG. 2A, the increase in force experienced by the extended portion 246 can be at a relatively slower rate than the increase in force experienced by the extended portion 206 in FIG. 2A as the second bracket component is moved to increase overlap of the extended portion 246 on the holder component 248 (in FIG. 2C), and the overall amount of force (e.g., latching force) that can be experienced by the extended portion 246 (e.g., when there is maximum overlap of the extended portion 246 on the holder component 248) will be less than the overall amount of force that can be experienced by the extended portion 206 (e.g., when there is maximum overlap of the extended portion 206 on the holder component 208), since the extended portion 206 can have more overlap on the holder component 208 than the amount of overlap the extended portion 246 can have on holder component 248.

Referring to FIG. 2D, illustrated is the portion of system 260, which can include a first bracket component 262 that can be attached to a door frame (not shown in FIG. 2D) and can be employed as a door stop and to facilitate latching the door (not shown in FIG. 2D) when the door is in the closed position in relation to the door frame. The system 260 can include a second bracket component 264 that can be attached to the door, for example, to facilitate latching of the door when the door is closed in relation to a door frame to which the door can be attached or can otherwise be associated. The second bracket component 264 can have an extended portion 266, which can be formed of a ferromagnetic material(s), and can employed to facilitate latching the door when the door is in the closed position, wherein the first bracket component 262 can comprise a holder component 268, which can include a permanent magnet that can produce a specified amount of magnetic force, and the holder component 268 can be inserted and/or adhered to a recessed area 270 formed in the first bracket component 262 in a region of the first bracket component 262 that can be aligned with the extended portion 266 of the second bracket component 264. The size of the recessed area 270 can be such that a desired portion of the extended portion 266 can be placed inside the recessed area 270. The holder component 268 can apply a desired amount of magnetic force to the extended portion 266 to hold the associated door in the closed position when the extended portion 266, or desired portion thereof, is in contact with the holder component 268, in accordance with the force profile associated with the extended portion 266.

In this embodiment, the extended portion 266 can be shaped such that it is in the form a triangle, which can give the extended portion 266 a non-linear force profile, which, for example, can be different from the non-linear force profiles disclosed herein with regard to FIGS. 2B and 2C. As a result, when the second bracket component 264 is adjusted in position in relation to the first bracket component 262 by moving the second bracket component 264 along its screw guides 272 to increase or decrease overlap of the extended portion 266 on the holder component 268, the amount of force that can be applied to the extended portion 266 by the holder component 268 when the door is in the closed position can increase non-linearly as the amount of overlap of the extended portion 266 on the holder component 268 increases (e.g., the rate of increase in magnetic force can vary (e.g., increase) as the amount of overlap increases), and can decrease non-linearly as the amount of overlap of the extended portion 266 on the holder component 268 decreases (e.g., the rate of decrease in the amount of magnetic force can vary (e.g., increase) as the amount of overlap decreases). As a further result, in comparison to the extended portion 206 of FIG. 2A, the increase in force experienced by the extended portion 266 can be at a relatively slower rate than the increase in force experienced by the extended portion 206 in FIG. 2A as the second bracket component is moved to increase overlap of the extended portion 266 on the holder component 268 (in FIG. 2D), and the overall amount of force (e.g., latching force) that can be experienced by the extended portion 266 (e.g., when there is maximum overlap of the extended portion 266 on the holder component 268) will be less than the overall amount of force that can be experienced by the extended portion 206 (e.g., when there is maximum overlap of the extended portion 206 on the holder component 208), since the extended portion 206 can have more overlap on the holder component 208 than the amount of overlap the extended portion 266 can have on holder component 268.

Turning to FIG. 3, illustrated is a diagram of an example system 300 that can efficiently stop and latch a door in accordance with an embodiment of the disclosed subject matter. In an aspect, the system 300 (e.g., a door latch/door stop system) can comprise a first bracket component 302 (e.g., door frame component) that can be attached to a portion of a door frame 304 at a desired location on the door frame 304. The system 300 also can include a second bracket component 306 (e.g., door bracket component) that can be attached to a door (e.g., swinging door, sliding door, etc.) (not shown in FIG. 3 for reason of clarity; e.g., as depicted in FIG. 5A) associated with the door frame 304. In an aspect, the first bracket component 302 and/or second bracket component 306 can be made from a desired material(s), such as a ferromagnetic material(s), which can be attracted to a force (e.g., magnetic force) when a force is applied thereto. The first bracket component 302 can be have a desired shape (e.g., rectangular, square, etc.) and size, wherein, for example, the first bracket component 302 can be large enough in size such that a portion of the first bracket component 302 can be desirably attached to the door frame 304 and a desired portion (e.g., overhanging portion 308) of the first bracket component 302 can overhang or extend beyond the door frame 304 and into the doorway so that the first bracket component 302 can be employed, in part, as a door stop and door latching mechanism for the door, which can be associated with (e.g., in the sliding groove of, attached to a side of) the door frame 304, when the door is being closed. That is, when the door is being closed, the door can come in contact with the overhanging portion 308 of the first bracket component 302 and the first bracket component 302, including the overhanging portion 308, can stop the door at that point where the overhang portion 308 is positioned in the doorway.

In an aspect, the second bracket component 306 can be shaped (e.g., substantially rectangular or square shaped with regard to the main body of the second bracket component 306) and sized, as desired, wherein there can be an extended portion 310 (e.g., tongue, tag), which can have a desired shape and size, that can extend out from the main body of the second bracket component 306. The extended portion 310 can be employed to facilitate stopping and latching of the associated door, for example, when the extended portion 310 comes in contact with a holder component 312 associated with the first bracket component 302.

The first bracket component 302 can further comprise a desired number of holder components, such as holder components 312 and 314, which can be attached or adhered to a corresponding number of respective recessed areas 316 and 318, for example, at or near desired edges of the first bracket component 302. In an embodiment, a holder component (e.g., 312, 314) can be or can include, for example, a permanent magnet that can produce at least a desired amount of force (e.g., magnetic force) to facilitate attracting and holding the extended portion 310 of the second bracket component 306 against the holder component 312 to thereby hold or latch the door in a desired predefined locational position (e.g., a specified location) in relation to the door frame 304 when the door is closed. The predefined locational position can be a desired locational position in relation to an operation device 320 (e.g., lock, such as an electromagnetic lock (as shown in FIG. 3); a sensor; a switch; etc.), which can be attached to the first bracket component 302 (e.g., on the overhanging portion 308 of the first bracket component 302), for example, using screws 322 that can be inserted into holes in the first bracket component 302 that can correspond to screw holes (not shown) in the operation device 320.

In an aspect, when the door is a sliding door, the door can be slid (e.g., from right to left with regard to FIG. 3) in a track (not shown) to the closed position wherein at such point the side of the door can be in contact with the door frame 304, and the extended portion 310 can desirably overlap (e.g., have a desired amount of overlap on the holder component) and be in contact with the holder component 312, which can apply a desired amount of latching force to the extended portion 310 to latch or hold the door in the closed position. To facilitate enabling the extended portion 310 to more easily engage or enter the recessed area 316, the edge 324 of the recessed area 316 can have a beveled or chamfered edge that can facilitate guiding the extended portion 310 into the recessed area 316 when the door is being slid to the closed position. The recessed area 318 also can have a beveled or chamfered edge 326, which can facilitate use of the first bracket component 302 when the door is slid from right to left to close the door, for example, as the first bracket component 302 can be turned 180 degrees from its orientation, as depicted in FIG. 3, so that the first bracket component 302 can be attached to the opposite side of the door frame 304, if the closed position for the door is on the right side of the door frame (right side portion of the door frame 304 is not shown for reasons of brevity and clarity).

In an aspect, the first bracket component 302 can be flexible in use, such that it can be used with various different types of doors (e.g., sliding doors, swinging doors, etc.) and various different orientations (e.g., door sliding closed from right to left (in accordance with FIG. 3), door sliding closed from left to right, door sliding down to the closed position, door swinging closed, etc.). The multiple recessed areas, recessed areas 316 and 318, can be located, for example, at two corners of the first bracket component 302 and recessed such that the extended portion 310 can enter the recessed area when a door swings closed, when a door is slid down to the closed position, when a door is slid closed from right to left (e.g., in accordance with FIG. 3), and/or when a door is slid closed from left to right, in relation to the door frame (e.g., 304).

In accordance with one embodiment, the operation device 320 can be a lock (e.g., an electromagnetic lock) that can employ a lock pin (e.g., lock bolt) (not shown) that can be moved between an unlocked position and a locked position to unlock or lock the door, using, for example, a solenoid actuator (not shown) with a solenoid plunger 328 desirably coupled to the lock pin. In an aspect, the second bracket component 306 can have a lock receptacle 330 attached thereto, wherein the lock receptacle 330 can have a hole thereon, and the hole can be aligned with the lock pin while the door is in a desired predefined locational position, so that the lock pin can engage or be inserted in the hole in the lock receptacle 330 to put the lock and associated door in the locked state. The lock can be, for example, a lock (e.g., lock component) such as is more fully described in co-pending U.S. patent application Ser. No. 12/789,989.

The second bracket component 306 can comprise screw guides 332 and the second bracket component 306 can be moved or adjusted along the screw guides 332 to facilitate adjusting the amount of overlap of the extended portion 310 on the holder component 312. When the desired amount of overlap, corresponding to a desired amount of latching force, is achieved, in accordance with the force profile associated with the extended portion 310, the second bracket component 306 and associated lock receptacle 330 can be firmly attached to the door (not shown) by tightening the screws 334 in corresponding screw holes on the door.

In an aspect, when closing and locking the door, the overhanging portion 308 of the first bracket component 302 can act as a door stop for the door, so that the door stops when it comes in contact with the overhanging portion 308, and the extended portion 310 of the second bracket component 306 comes in contact with the holder component 312. When the door is stopped in the closed position, the force (e.g., magnetic force) of the holder component 312 can have desired strength (e.g., sufficient strength) to hold or latch the extended portion 310 to thereby latch the door and hold the door closed in the desired predefined locational position. As disclosed herein, the predefined locational position of the door (and thus, the lock receptacle 330) can be selected such that, when the door is in that position, the lock pin of the lock component and the hole in the lock receptacle 330 can be desirably aligned in relation to each other so that when the lock component is switched to the locked state, the solenoid plunger 328 can transition the lock pin to engage or be inserted in the hole in the lock receptacle 330 to lock the door with respect to the door frame 304.

It is to be appreciated and understood that, in accordance with various embodiments, an operation device can be or can comprise a lock (e.g., electromagnetic lock), a sensor (e.g., Radio-Frequency Identification (RFID) sensor), a magnetic card reader for receiving authentication credentials (e.g., as contained on a card with a magnetic strip), a keypad or other interface (e.g., touch screen graphical user interface) for receiving authentication credentials (e.g., password, passcode, Personal Identification Number (PIN), etc.), a scanner for scanning or reading information (e.g., authentication credentials) contained in a smart card, a biometric scanner that can scan biometric information associated with a user to facilitate authenticating the user, and/or other interfaces or components, to facilitate controlling operation of the door and access to the associated defined physical area. For example, an operation device can comprise a lock and a magnetic card reader, wherein the lock associated with the door can be unlocked and opened in response to a user swiping a magnetic strip on the user's card, comprising proper authentication credentials embedded on the magnetic strip, through a reader on the magnetic card reader, and the magnetic card reader granting access to the user. As another example, an operation device can comprise a lock and an RFID sensor, wherein the lock associated with the door can be unlocked and opened in response to the RFID sensor sensing or scanning information (e.g., proper authentication credentials) contained on the user's RFID card and granting access to the user.

Figure 4:
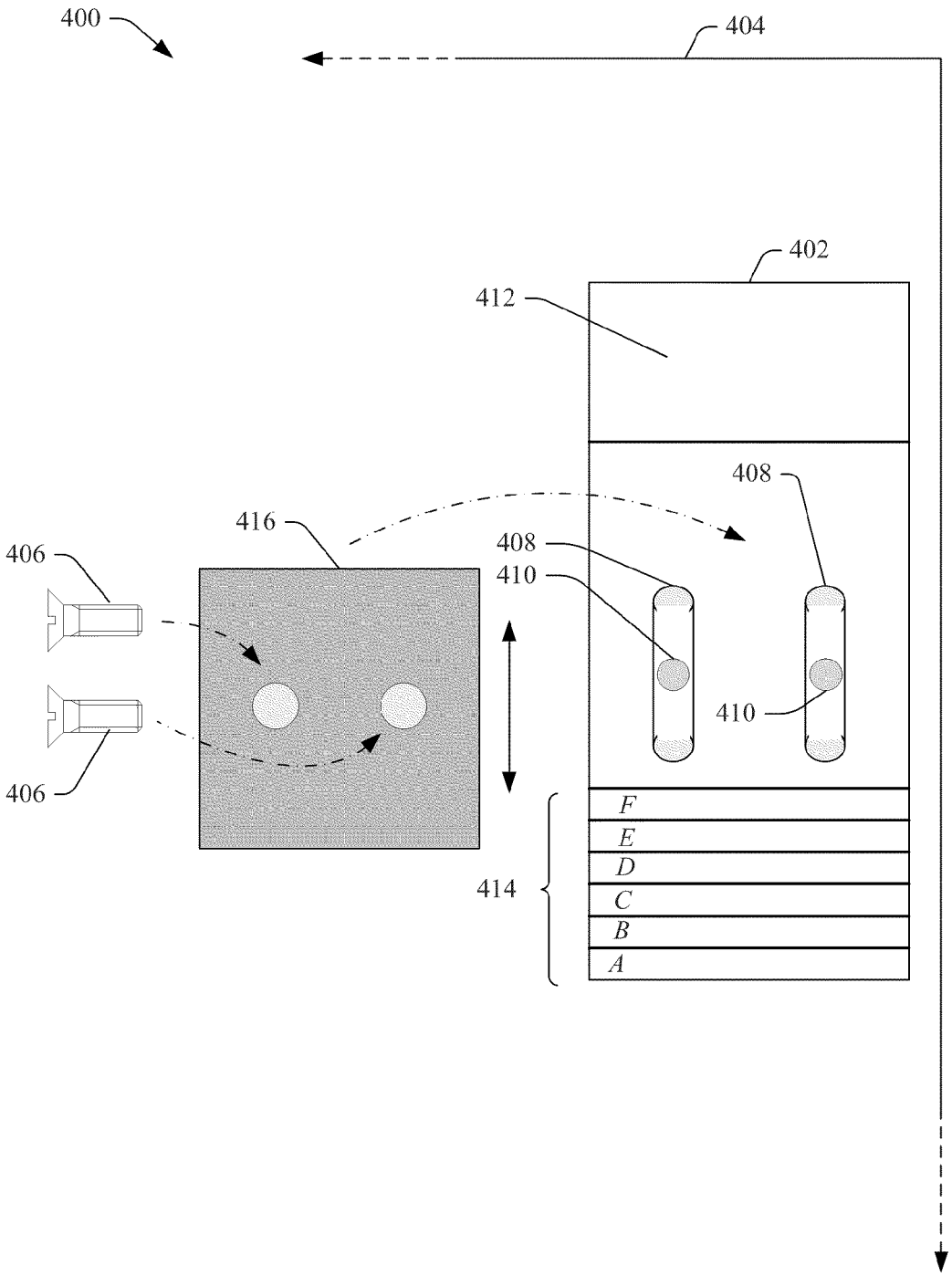
FIG. 4 depicts a diagram of an example system that can facilitate intelligently adjusting and selecting a desired amount of force to be applied to an extended portion (e.g., tongue, tag) of a second bracket component (e.g., door bracket component) in accordance with an embodiment of the disclosed subject matter.

FIG. 4 depicts a diagram of an example system 400 that can facilitate intelligently adjusting and selecting a desired amount of force to be applied to an extended portion (e.g., tongue, tag) of a second bracket component (e.g., door bracket component) in accordance with an embodiment of the disclosed subject matter. In an aspect, the system 400 can include a second bracket component 402 that can be attached to a door 404, using, for example, screws 406, at a desired position within the screw guides 408. The screw guides 408 can be oblong shaped holes in the second bracket component 402 that can facilitate adjusting the second bracket component 402 to a desired position, wherein the second bracket component 402 can be fastened to the door 404 in the desired position by inserting and tightening the screws 406 in the screw holes 410 in the door 404 via the screw guides 408 at a position in the screw guides 408 that corresponds with the desired position of the second bracket component 402.

In another aspect, the second bracket component 402 can comprise an extended portion 412 (e.g., tongue, tag), which can run the entire width of the second bracket component 402 (as depicted in FIG. 4) or can span a portion of the width of the second bracket component (e.g., as depicted in FIG. 1). When the door is placed in a closed position in relation to an associated door frame (not shown in FIG. 4), a first bracket component comprising a holder component in a recessed area (not shown in FIG. 4; as depicted, for example, in FIGS. 1-3), which can be attached to the door frame, can be in proximity to the extended portion 412 and the holder component can be in contact with at least a portion of the extended portion 412 and can apply a desired amount of magnetic force to the extended portion 412 to latch or hold the door in the closed position, in accordance with the force profile of the extended portion 412, wherein the force profile can be based at least in part on the shape of the extended portion 412.

In still another aspect, the system 400 can provide a user with information regarding the amount of latching force that is being applied to the extended portion 412 by the holder component to latch the door, so that the user can intelligently adjust the amount of latching force to a desired level to facilitate desirable (e.g., smooth and safe) latching and unlatching of the door. The second bracket component 402 can include, or can have adhered thereon (e.g., using a suitable adhesive material), a force level guide 414 that can show the respective amounts of latching force that can be applied to the extended portion 412 by the holder component at respective positions of the extended portion 412 of the second bracket component 402 in relation to the holder component associated with the first bracket component. The force level guide 414 can comprise a set of force level lines or grooves that each has a respective force level, such as, for example, force level A, force level B, force level C, . . . , force level F, . . . , associated therewith, wherein the force levels can be in a desired format (e.g., numerical value associated with a desired unit of measure) and a desired level of granularity (e.g., a force level every 5 N or every 10 N; a specified number of different force levels over the available range of force levels; etc.) to facilitate enabling a user to view and understand the amount of latching force being applied for each position of the second bracket component 402, and thus, the position of the extended portion 412 in relation to the holder component (e.g., amount of overlap of the extended position 412 on the holder component). For example, the first line (e.g., force level A) can indicate 10 N, the second line (e.g., force level B can indicate 20 N, the third line (e.g., force level C) can indicate 30 N, etc.

When the second bracket component 402 is adjusted or moved about its screw guides 408 to adjust the amount of overlap of the extended portion 412 in relation to the holder component, the force level guide 414 can indicate the amount of latching force that corresponds with the position of the second bracket component 402 in relation to the holder component and/or associated operation device 416, or portion thereof (e.g., component, such as a lock receptacle, of the associated operation device). For instance, the user can view the amount of latching force indicated on the force level guide 414 at a particular position of the second bracket component 402 when the portion of the operation device 416 is in a desired position (e.g., predefined locational position) in relation to another portion of the operation device 416 attached to the first bracket component, so the user can be informed as to the amount of latching force and can adjust the position of the second bracket component 414 to thereby adjust the amount of overlap of the extended portion 412 on the holder component, and thereby adjust or control the amount of latching force, to achieve the desired amount of latching force on the extended portion 412 and thereby the associated door. An edge of the portion of the operation device 416 to be attached to the second bracket component 402 can be used with the force level guide 414 to facilitate determining the amount of latching force for a given position (e.g., when the portion of the operation device 416 is in the desired position, the amount of force indicated at the bottom edge of the portion of the operation device 416 can be the amount of force that will be applied is the second bracket component 402 is attached in that position). The respective force levels indicated by the force level guide 414 and the placement of the corresponding force level lines or grooves (e.g., respectively associated with force levels A through F) can be determined based at least in part on the shape of the extended portion 412, the type of material used to form the extended portion 412, and the magnetic force of the holder component. In accordance with various embodiments, the force level guide 414 can be formed on the second bracket component 402, wherein, for example, force level lines and respectively associated force level values can be formed in or on a surface of the second bracket component 402 (e.g., surface facing outward when attached to the door 404; or the force level guide 414 can be formed on a force level plate, which can be formed of metal, polymer-based material, paper, or other desired material, and can be attached or adhered to the surface of the second bracket component 402).

FIG. 5A depicts a diagram of an example system 500 that can facilitate reducing an amount of impact on an operation device due to closing of a door in accordance with an embodiment of the disclosed subject matter. The system 500 (e.g., a door latch/door stop system) can comprise a first bracket component 502 (e.g., door frame component) that can be attached to a portion of a door frame 504 at a desired location on the door frame 504. The system 500 also can include a second bracket component 506 (e.g., door bracket component) that can be attached to a door 508 (e.g., swinging door, sliding door, etc.) associated with the door frame 504 (e.g., attached to a portion of the door frame 504, inserted in a track of the door frame 504, etc.). In an aspect, the first bracket component 502 and/or second bracket component 506 can be made from a desired material(s), such as a ferromagnetic material(s), which can be attracted to a magnetic force when a force (e.g., magnetic force) is applied thereto. The first bracket component 502 can be have a desired shape (e.g., rectangular, square, etc.) and size, wherein, for example, the first bracket component 502 can be large enough in size such that a portion of the first bracket component 502 can be desirably attached to the door frame 504 and a desired portion (e.g., overhanging portion 510) of the first bracket component 502 can overhang or extend beyond the door frame 504 and into the doorway so that the first bracket component 502 can be employed, in part, as a door stop and door latching mechanism for the door 508, which can be associated with (e.g., in the sliding groove of, attached to a side of) the door frame 504, when the door 508 is being closed. That is, when the door 508 is being closed, the door 508 can come in contact with the overhanging portion 510 of the first bracket component 502 and the first bracket component 502, including the overhanging portion 510, can stop the door 508 at that point.

In an aspect, the second bracket component 506 can be shaped (e.g., substantially rectangular or square shaped with regard to the main body of the second bracket component 506) and sized, as desired, wherein there can be an extended portion 512 (e.g., tongue, tag), which can be desirably shaped and sized, that can extend out from the main body of the second bracket component 506. The extended portion 512 can be employed to facilitate stopping and latching of the associated door 508, for example, when the extended portion 512 comes in contact with a holder component 514, attached to or inserted in a recessed area 516 of the first bracket component 502. When the door 508 is closed, the holder component 514 can apply a desired amount of latching force on the extended portion 512 to latch or hold the door in the closed position, which can be a predefined locational position to facilitate operations associated with the door 508 (e.g., locking the door 508, sensor-related operations, etc.).

In still another aspect, the first bracket component 502, including the overhanging portion 510, can function as a shock or force absorber for an operation device 518 attached to the overhanging portion 510 of the first bracket component 502. For instance, the first bracket component 502, with the overhanging portion 510 that overhangs beyond the door frame 504, can function as a type of cantilever, wherein the material that forms the first bracket component 502 can have at least some level of elasticity, and when the door 508 impacts and is stopped by the overhanging portion 510 of the first bracket component 502, the first bracket component 502 can absorb at least a portion of the impact of the door 508, which can reduce the amount of shock, vibration, or force that is impacted on (e.g., transferred to) the operation device 518, or portion thereof, that is attached to the first bracket component 502.

Turning briefly to FIG. 5B (along with FIG. 5A), illustrated is an example system 550 that can employ a shock absorber component, which can further reduce impact of a door on an operation device 518 when the door is closed in accordance with an embodiment of the disclosed subject matter. In this embodiment, when desired, a shock absorber component 552, which can be fabricated from a desired material(s) (e.g., polymer-based material, such as rubber or plastic; felt; etc.) and can have a desired thickness and shape (e.g., shape that corresponds to the shape of the surface of the overhanging portion 510 with which the shock absorber component 552 will be in contact and/or the shape of the side of the operation device 518 with which the shock absorber component 552 will be in contact), can be inserted between the first bracket component 502 and the operation device 518 to provide further shock or force absorption, beyond the shock absorption provided by the first bracket component 502, in relation to the operation device 518 to thereby further reduce the amount of shock, vibration, or force impacted on the operation device 518 when the door 508 impacts (e.g., comes in contact with) the overhanging portion 510 of the first bracket component 502 when the door 508 is being stopped by the first bracket component 502 when the door 508 is being latched to the desired predefined locational position for the closed state.

FIG. 6 depicts a diagram of an example system 600 that can facilitate monitoring integrity of the door latch/door stop system to facilitate system security and maintenance in accordance with an embodiment of the disclosed subject matter. In an aspect, the system 600 can comprise a first bracket component 602, second bracket component 604, extended portion 606, holder component 608, recessed area 610, and screw guides 612 that each can comprise the same or similar features (or a desired portion thereof), or same or similar functionality (or a desired portion thereof), as respective components such as more fully described herein, for example, with regard to system 100, system 200, system 300, system 400, and system 500.

In accordance with one aspect, the first bracket component 602 can be attached to a door frame (not shown) wherein there can be an overhang portion 614 on the first bracket component 602 that can overhang or extend beyond the door frame and into the doorway formed by or within the door frame. The first bracket component 602 can comprise the recessed area 610 formed in a desired region (e.g., at or near a corner) in the overhang portion 614 of the first bracket component 602.

The second bracket component 604 can be attached to a door (not shown) associated with the door frame. The second bracket component 604 can have an extended portion 606 that can comprise a holder component 608 (e.g., permanent magnet) that can be located (e.g., attached) on the region of the extended portion 606 that faces the recessed area 610 when the door is in the closed position. The extended portion 606, and correspondingly the holder component 608, of the second bracket component 604 can have a desired shape and size in order to produce a desired force profile to facilitate desired latching of the door in the closed position by the holder component 608 and the extended portion 606. Additionally or alternatively, the recessed area 610 can have the shape and size of the region that is formed of a ferromagnetic material formed to a desired shape and size in order to produce a desired force profile. The position of the second bracket component 604 can be adjusted to thereby adjust the amount of overlap of the holder component 608 on the recessed area 610 when the door is in the desired predefined locational position (e.g., desired closed position, wherein the holder component 608 is in contact with and/or is applying the desired amount of latching force to the recessed area 610 to hold the extended portion 606 (and holder component 608) against the recessed area 610 and thereby hold the door in the desired closed position).

In an embodiment, an operation device(s) 616 (e.g., lock component, RFID sensor, magnetic card reader, biometric scanner, etc.) can be attached to the first bracket component 602 with an associated operation facilitator component 618 (e.g., lock receptacle) attached to the second bracket component 604. The operation device 616 can perform desired operations (e.g., locking and/or monitoring and controlling access to the defined physical area, controlling access to the defined physical area being secured by the door, etc.) associated with the door and defined physical area.

In accordance with an aspect, the system 600 also can comprise a remote operation system 620 that can employ an operation platform 622 to control and/or monitor operations associated with the door (e.g., latching operations, lock operations, sensor operations, etc.) and associated defined physical area, for example. The operation platform 622 can include an operation integrity component 624 that can monitor and sense conditions associated with the first bracket component 602 and second bracket component 604, the door and associated door frame, and/or the operation device 616 attached to the first bracket component 602 and/or second bracket component 604 to facilitate securing the door and associated defined physical area, as desired, and maintaining desirable operation of the system 600.

In an embodiment, the operation integrity component 624 can be associated with (e.g., electrically connected with and/or communicatively connected with via a wired or wireless communication connection) a sensor component 626 (e.g., magnetic field sensor, which, for example, can be or can include a Reed Switch or Hall-effect sensor) that can be associated with (e.g., connected to, implanted in) the recessed area 610 of the first bracket component 602 and can sense the amount of magnetic field applied to the recessed area 610 by the holder component 608, or at least can sense a change in state (e.g., magnetized state, unmagnetized state) on the recessed area 610, on a continuous basis, periodic basis, or in response to a request (e.g., a request from the remote operation system 620, for example, when such request is received from a user). When the sensor component 626 senses or detects a particular condition (e.g., unlatched extended portion 606, properly latched extended portion 606, improperly latched extended portion 606), the sensor component 626 can automatically generate and transmit a respective signal (e.g., unlatched signal, proper latch signal, defective latch signal) that can correspond with the sensed condition, wherein the respective signal can be received by the operation integrity component 624 and/or a local component associated with the door (e.g., door status interface (not shown)). The respective signals (e.g., feedback signals) from the sensor component 626 can thereby serve as a Magnetic Bond Sensor (MBS) output as well as a Door Status Switch (DSS) for the door latch formed by the extended portion 606 (with the associated holder component 608) and recessed area 610.

For instance, when the door is in the open position in relation to the door frame, the sensor component 626 can sense that the amount of magnetic force applied to or experienced by the recessed area 610 is low (e.g., at or near 0 N) and can transmit an open or unlatched signal that indicates the door is not latched (e.g., the recessed area 610 is not latched to the holder component 608) and is thus in an open state to the operation integrity component 624. When the door is properly closed and latched, the sensor component 626 can sense that the amount of magnetic force applied to or experienced by the recessed area 610 is relatively high (e.g., at or above the predefined minimum threshold latching force level that indicates the recessed area 610 is desirably latched to the holder component 608), and the sensor component 626, can transmit a latched signal (e.g., proper latch signal), which indicates the recessed area 610 is desirably latched to the holder component 608 on the extended portion 606, to the operation integrity component 624, and thus, the door is desirably latched in the closed state. As desired, when the door is properly open or closed, respectively, in relation to the door frame, a respective visual indicator or audio indicator indicating proper operation and/or current status of the door (e.g., door latching) also can be provided, for example, by the local door status interface (in response to a corresponding signal from the sensor component 626) to let a user near the door know the current status of the door latching.

In an aspect, when there is a latching problem between the recessed area 610 and holder component 608 when the door is in the closed position (e.g., door is misaligned in relation to the door frame, the extended portion 606, and thus the holder component 608, is misaligned in relation to the recessed area 610, etc.), the sensor component 626 can sense that the force applied to or experienced by the recessed area 610 from the holder component 608 does not meet the minimum threshold latching force level, which can indicate a defective condition in the latching of the holder component 608 on the recessed area 610. When the force does not meet the minimum threshold latching force level (but, for example, is above a predefined force level—below which indicates an open or unlatched door), the sensor component 626 can transmit a latch defect signal to the operation integrity component 624. In response to the latch defect signal, the operation integrity component 624 can generate and transmit a defective latch indicator to the operation device 616 or a desired local interface (e.g., door status interface), wherein the operation device 616 and/or desired local interface can produce a visual or an audio signal to let a user know that the latching between the recessed area 610 and holder component 608 is defective. The operation integrity component 624 also can facilitate generating and providing a latch defect ticket or token, which can be provided to a maintenance system (not shown) or maintenance person to facilitate having the latch defect checked out and rectified. Alternatively or additionally, the latch defect signal can be communicated directly or locally from the sensor component 626 to the door status interface associated with or near the door and the door status interface can broadcast a visual signal (e.g., flashing and/or colored light indicative of latch defect) or an audio signal (e.g., beeping or other sound indicative of a latch defect) to let a user near the door know of the latch defect.

The sensor component 626 can be useful, for example, when the operation device 616 is a lock component with a lock pin, wherein the lock component is attached to the first bracket component 602 and the associated operation facilitator component 618, in this example, a lock receptacle, is attached to the second bracket component 604, as, when the door latching is operating properly, the sensor component 626 can sense the proper operation of the door latching (e.g., can sense that the magnetic force on the recessed area 610 at least meets the minimum threshold latching force level) and thereby can indicate when the second bracket component 604 and associated lock receptacle are in the desired predefined locational position in relation to the lock pin associated with the first bracket component 602, so that when the lock pin is moved to the locked position, the lock pin can successfully engage the hole in the lock receptacle to lock the door.

Over time and/or for other reasons (e.g., abuse of the door or door latching system), the door may become misaligned, and, as a result, can cause misalignment of the extended portion 606 and/or the holder component 608 in relation to the recessed area 610, and also can cause misalignment of the lock pin in relation to the hole in the lock receptacle, which can negatively affect operations associated with the door (e.g., door is unable to be locked because the lock pin is not able to engage the hole in the lock receptacle). The misalignment of the extended portion 606 in relation to the holder component 608 can result in a change in the strength of the magnetic field applied by the holder component 608 on the recessed area 610 when the holder component 608 is being latched to the recessed area 610 or an attempt is being made to latch the holder component 608 to the recessed area 610. The sensor component 626 can detect the force field strength (e.g., magnetic field strength) at the recessed area 610 and can detect that the force on the recessed area 610 does not at least meet the predefined minimum threshold latching force, and can send feedback relating to the detected force field strength (e.g., latch defect signal, amount of force field strength), for example, to the operation integrity component 624. The operation integrity component 624 can analyze the feedback information from the sensor component 626 and can identify that the force field strength has changed to an undesirable level, and can determine that the door and/or extended portion 606 is misaligned or at least is likely misaligned, and a maintenance or defect ticket can be generated to have a maintenance person check out the door and the door latch/door stop system and correct any defect so that the system operates properly. Further, the operation integrity component 624 can transmit a defective latch indicator to the operation device 616 or a desired local interface (e.g., door status interface) associated therewith or in proximity thereto, wherein the operation device 616 and/or desired local interface can produce a visual signal or an audio signal to let a user know that the latching between the extended portion 606 (with associated holder component 608) and recessed area 610 is defective.

In another aspect, the remote operation system 620 also can facilitate controlling operations associated with the operation device 616. For example, when the operation device 616 is a lock component (e.g., employing a bi-stable latching solenoid), the remote operation system 620 can control locking and unlocking of the lock component, and thus, the associated door, to control access to the defined physical area associated with the door. For instance, the remote operation system 620 can monitor power conditions associated with the operation device 616, and can employ a sensor that can detect when a power off condition is impending with regard to the operation device 616 (e.g., impending loss of power to the operation device 616, undesirable power fluctuations in power supplied to the operation device 616), and can place or transition the operation device 616 into a desired operating state (e.g., locked position) in response to the detected power off condition, and/or can perform other desired operations, as are more fully disclosed in related co-pending U.S. patent application Ser. No. 12/789,989.

In an aspect, the remote operation system 620 can employ a processor component 628 that that can work in conjunction with the other components (e.g., operation platform 622, operation integrity component 624, etc.) to facilitate performing the various functions of the remote operation system 620. The processor component 620 can employ one or more processors, microprocessors, or controllers that can process data, such as information relating to received feedback information (e.g., respective signals indicative of door latching status, current state of the door, operation status of an operation device 616, etc.), information relating to operations of the remote operation system 620, and/or other information, etc., to facilitate operation of the remote operation system 620, operation related to latching or securing the door and the associated defined physical area, and operation of system 600 overall; and can control data flow between the remote operation system 620 and other components (e.g., sensor component 626, door status interface, operation device, etc.) that are or can be associated with the remote operation system 620.

The remote operation system 620 also can include a data store 630 that can store data structures (e.g., user data, metadata); code structure(s) (e.g., modules, objects, classes, procedures) or instructions; information relating to latching conditions between the holder component 608 and the recessed area 610, operating conditions or operating state of the operation device 616, predefined operation criteria, predefined minimum threshold latching force, predefined magnetic force level (e.g., at or near 0 N) at or below which indicates an unlatched state, etc., to facilitate controlling operations associated with the remote operation system 620, etc. In an aspect, the processor component 628 can be functionally coupled (e.g., through a memory bus) to the data store 630 in order to store and retrieve information desired to operate and/or confer functionality, at least in part, to the operation platform 622, operation integrity component 626, and/or substantially any other operational aspects of the remote operation system 620. For instance, in accordance with various embodiments, the systems (e.g., operating environment, sample computing environment) disclosed herein with regard to FIGS. 12 and 13 can be employed to facilitate operations associated with system 600.

It is to be appreciated and understood that, while, depicted in FIG. 6 and described herein, the holder component 608 is attached to the extended portion 606 and the sensor component 626 is associated with the recessed area 610, the subject specification is not so limited, as in accordance with another embodiment, the holder component 608 can be associated with (e.g., attached to) the recessed area 610 (e.g., as depicted in FIG. 1) and the sensor component 626 can be attached to the extended portion 606, wherein the respective components can function substantially as otherwise described herein.

FIGS. 7-11 illustrate methodologies and/or flow diagrams in accordance with the disclosed subject matter. For simplicity of explanation, the methodologies are depicted and described as a series of acts. It is to be understood and appreciated that the subject innovation is not limited by the acts illustrated and/or by the order of acts, for example acts can occur in various orders and/or concurrently, and with other acts not presented and described herein. Furthermore, not all illustrated acts may be required to implement the methodologies in accordance with the disclosed subject matter. In addition, those skilled in the art will understand and appreciate that the methodologies could alternatively be represented as a series of interrelated states via a state diagram or events. Additionally, it should be further appreciated that the methodologies disclosed hereinafter (or at least portions thereof) and throughout this specification are capable of being stored on an article of manufacture to facilitate transporting and transferring such methodologies to computers or other processing devices. The term article of manufacture, as used herein, can encompass a computer program accessible from any computer-readable device, carrier, or media.

Figure 7:
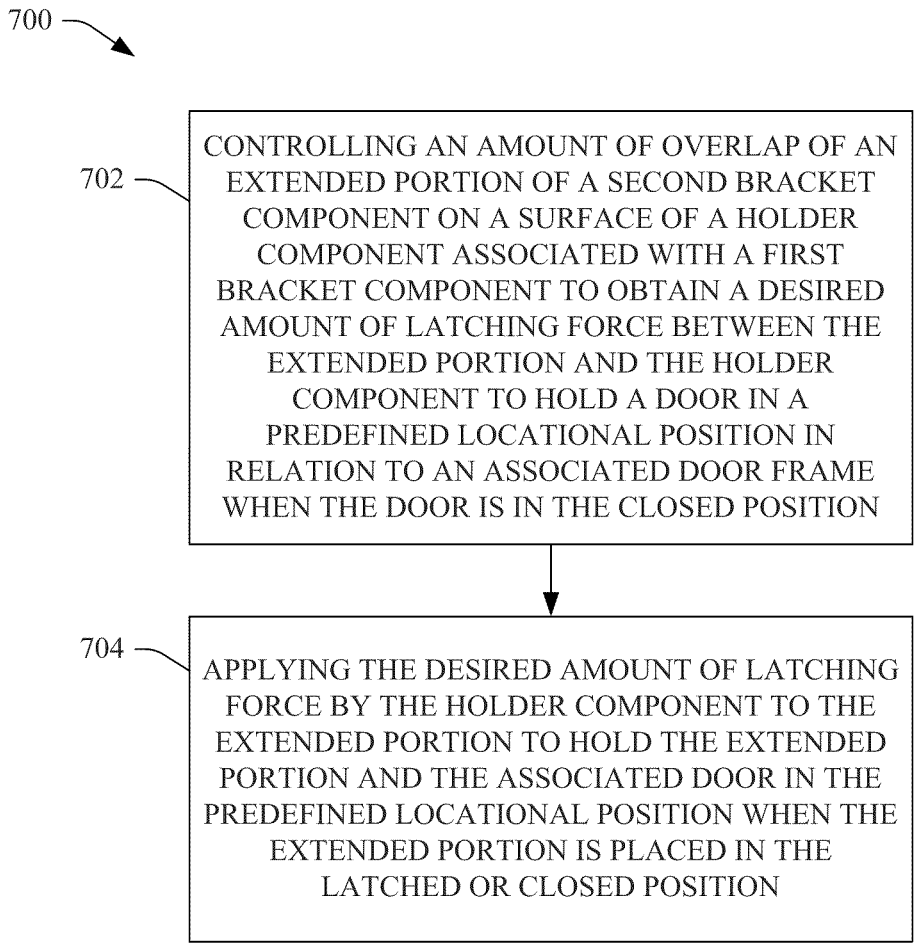
FIG. 7 illustrates a flowchart of an example methodology that can facilitate efficient latching of a door in accordance with various aspects and embodiments of the disclosed subject matter.

Now referring to FIG. 7, illustrated is an example methodology 700 that can facilitate efficient latching of a door in accordance with various aspects and embodiments of the disclosed subject matter. At 702, an amount of overlap of an extended portion of a second bracket component on a surface of a holder component associated with a first bracket component can be controlled to obtain a desired amount of latching force between the extended portion and the holder component to hold a door associated with one of the extended portion or the holder component in a predefined locational position in relation to an associated door frame when the door is in the closed position. In an embodiment, the first bracket component can be attached to the door frame and the second bracket component can be attached to a door, wherein the overlap of the extended portion of the second bracket component on a holder component can be adjusted to facilitate correspondingly adjusting the amount of latching force between the extended portion and holder component in accordance with a force profile associated with the extended portion. At 704, the desired amount of latching force (e.g., magnetic force) can be applied by the holder component to the extended portion to hold the extended portion and the associated door in the predefined locational position when the extended portion is placed in the latched or closed position.

Figure 8:
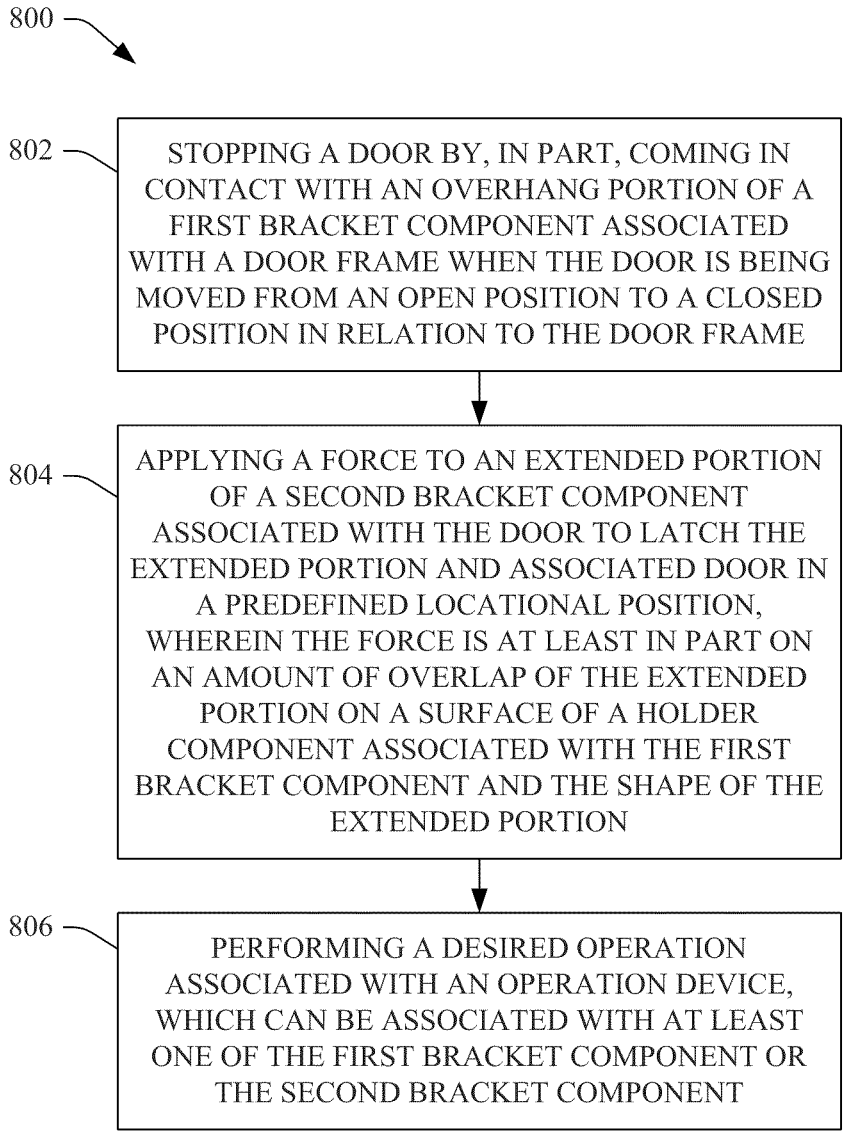
FIG. 8 depicts a flowchart of an example methodology that can facilitate stopping and latching of a door in accordance with an aspect of the disclosed subject matter.

FIG. 8 depicts an example methodology 800 that can facilitate stopping and latching of a door in accordance with an aspect of the disclosed subject matter. At 802, a door can be stopped by, in part, coming in contact with an overhang portion of a first bracket component associated with a door frame when the door is being moved from an open position to a closed position in relation to the door frame.

At 804, a force can be applied to an extended portion of a second bracket component associated with the door to latch the extended portion and associated door in a predefined locational position, wherein the force can be based at least in part on an amount of overlap of the extended portion on a surface of a holder component associated with the first bracket component and the shape of the extended portion.

At 806, a desired operation associated with an operation device, which can be associated with at least one of the first bracket component or the second bracket component, can be performed. For instance, when the operation device is a lock component (e.g., electromagnetic lock comprising a bi-stable latching solenoid), and the extended portion and associated door are in the predefined locational position in relation to the door frame, which can occur when the extended portion is properly latched to the holder component, the lock pin of the lock component, which can be attached to the overhanging portion of the first bracket component, can be placed in a locked position by engaging a hole in a lock receptacle, which can be attached to the second bracket component to place the door in a locked state.

Figure 9:
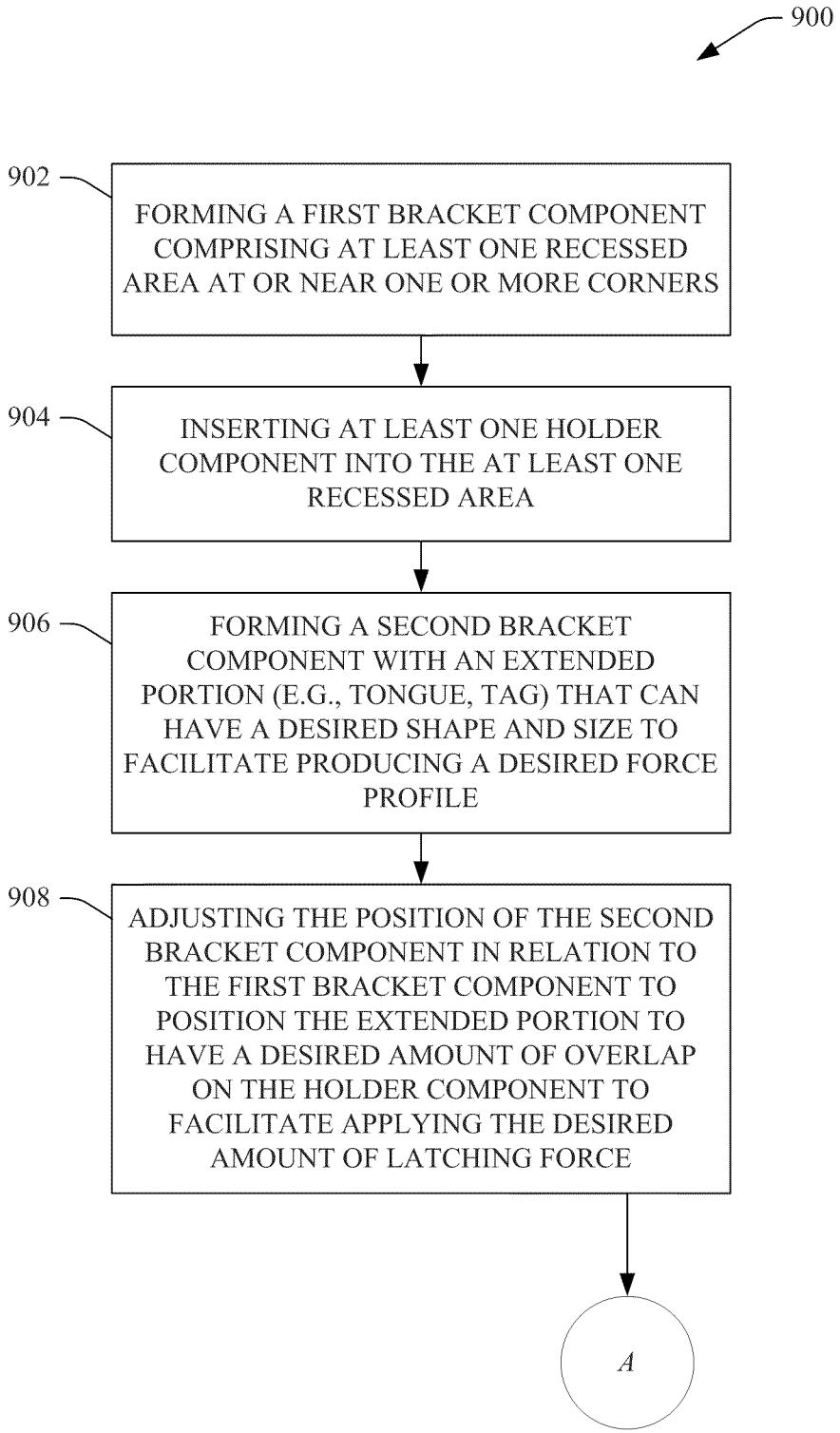
FIG. 9 illustrates a flowchart of an example methodology for fabricating a door stop/door latch in accordance with an aspect of the disclosed subject matter.

FIG. 9 illustrates an example methodology 900 for fabricating a door stop/door latch in accordance with an aspect of the disclosed subject matter. At 902, a first bracket component can be formed, wherein the first bracket component can comprise at least one recessed area at or near one or more corners of the first bracket component. If and when the first bracket component is attached to, for example, a door frame, the at least one recessed area can be located at or near a corner(s) that will be part of the overhang portion of the first bracket component that will be overhanging or extending outward beyond the door frame and into the doorway.

At 904, at least one holder component can be inserted into the at least one recessed area. The at least one holder component can be, for example, a permanent magnet that can produce and apply at least a desired amount of force to the extended portion to desirably latch and hold the extended portion and thereby the associated door in a closed position (e.g., predefined locational position) in relation to the door frame (e.g., can apply the desired amount of force, or can produce more than the desired amount of force wherein the amount of force ultimately applied to the extended portion can be controlled based at least in part on the shape of the extended portion and the amount of overlap of the extended portion on the holder component).

At 906, the second bracket component can be formed with an extended portion (e.g., tongue, tag) that can have a desired shape and size to facilitate producing a desired force profile. At 908, the position of the second bracket component can be adjusted in relation to the first bracket component to position the extended portion to have a desired amount of overlap on the holder component to facilitate enabling the holder component to apply the desired amount of latching force on the extended portion to latch or hold the extended portion in a predefined locational position in accordance with the force profile (e.g., force profile that is based at least in part on the shape and size of the extended portion) when the door is being placed in the closed position. At this point, methodology 900 can end and/or proceed to reference point A, wherein, as desired, methodology 1000 can proceed from reference point A, as more fully disclosed herein.

Figure 10:
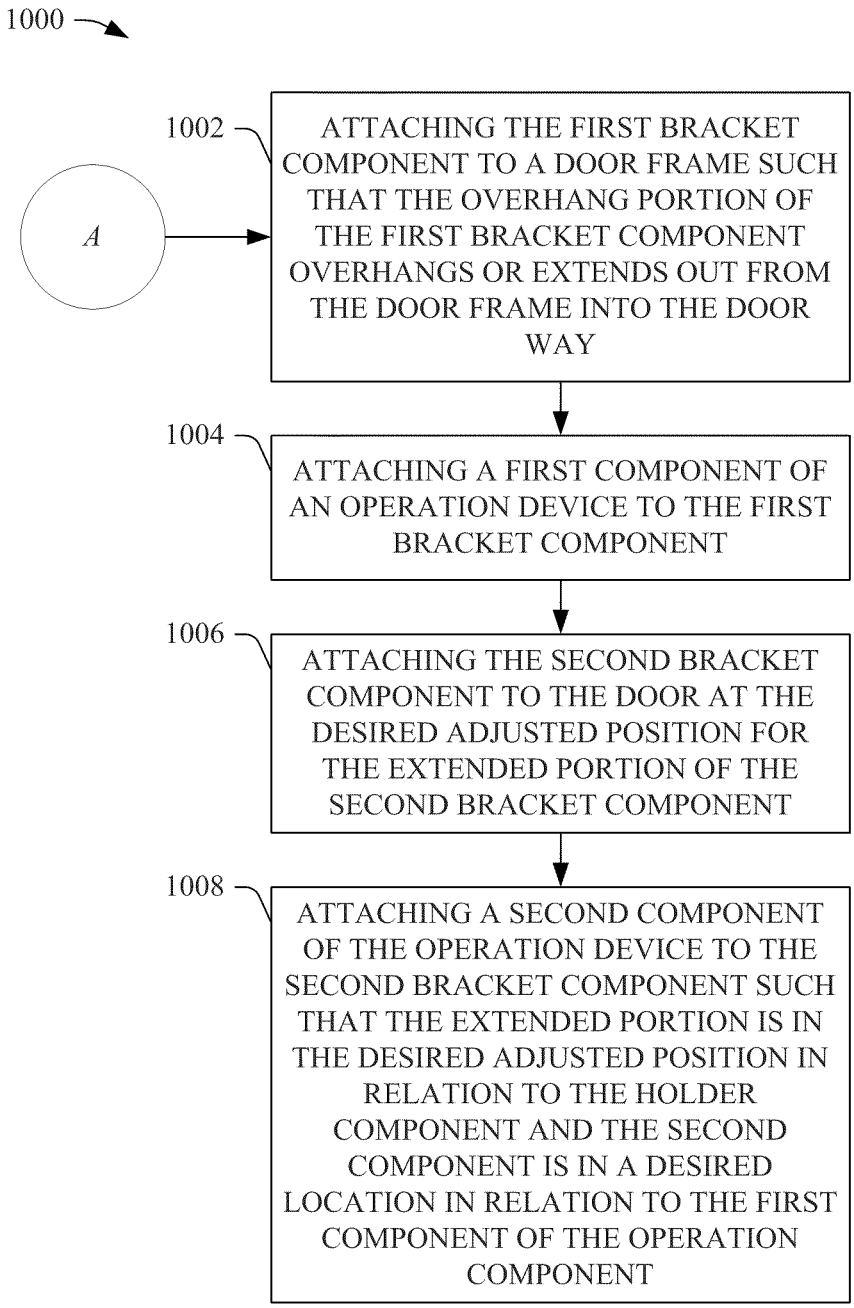
FIG. 10 depicts a flowchart of an example methodology that can facilitate construction of a door stop/door latch in accordance with an aspect of the disclosed subject matter.

Referring to FIG. 10, illustrated is an example methodology 1000 that can facilitate construction of a door stop/door latch in accordance with an aspect of the disclosed subject matter. As desired, Methodology 1000 can proceed from reference point A, wherein methodology 900 ended. At 1002, the first bracket component can be attached to a door frame such that the overhang portion of the first bracket component overhangs or extends out from the door frame into the door way.

At 1004, a first component of an operation device can be attached to the first bracket component. In an aspect, the operation device can be a lock (e.g., electromagnetic lock), and/or sensor (e.g., RFID sensor, magnetic card reader, biometric scanner, movement sensor, etc.), wherein the first component can be, for example, a solenoid actuator (e.g., bi-stable solenoid actuator) when the operation device is a lock or a sensing portion of a sensor. In an embodiment, as desired, a shock absorber component can be inserted in between the overhang portion of the first bracket component and the first component of the operation device to further reduce the impact (e.g., shock, vibration) on the first component of the operation device, beyond the shock or impact absorption that is already provided by the first bracket component, when the door impacts the overhang portion, wherein the overhang portion can act as a door stop, when the door is moved from the open position to the closed position.

At 1006, the second bracket component can be attached to the door at the desired adjusted position for the extended portion of the second bracket component. In an aspect, the position of the extended portion of the second bracket component can be adjusted in relation to the position of the holder component associated with the first bracket component to facilitate achieving a desired amount of latching force in accordance with the force profile associated with the extended portion.

At 1008, a second component of the operation device can be attached to the second bracket component such that the extended portion is in the desired adjusted position in relation to the holder component and the second component is in a desired location in relation to the first component of the operation component attached to the first bracket component. In an aspect, the second component of the operation device can be attached to the second bracket component and the door, for example, by using screws that can be inserted in screw holes in the second component through adjustable screw guides in the second bracket component and into screw holes on the door, wherein the screws can be tightened to attach and hold the second component and second bracket component in the desired adjusted position in relation to each other and the holder component such that a desired amount of latching force can be applied to the extended portion when the door is in the closed position and, when the door is latched, the second component can be in a desired predefined locational position in relation to the first component of the operation device to facilitate proper operation of the operation device (e.g., so the lock pin of the first component (e.g., electromagnetic lock) can engage the hole in the second component (e.g., lock receptacle)).

It is to be appreciated and understood that, while the methodologies disclosed herein primarily describe the holder component as being associated with the recessed area of the second bracket component and applying a force to the extended portion to hold the extended portion of the first bracket component during latching, the subject specification is not so limited, as in accordance with various embodiments, the holder component can be associated with (e.g., attached to) the extended portion and can apply a desired force to latch to the recessed area (or another component attached thereto or formed thereon) of the second bracket component (e.g., as described with regard to methodology 1100), wherein the respective components can function substantially as otherwise described herein.

Figure 11:
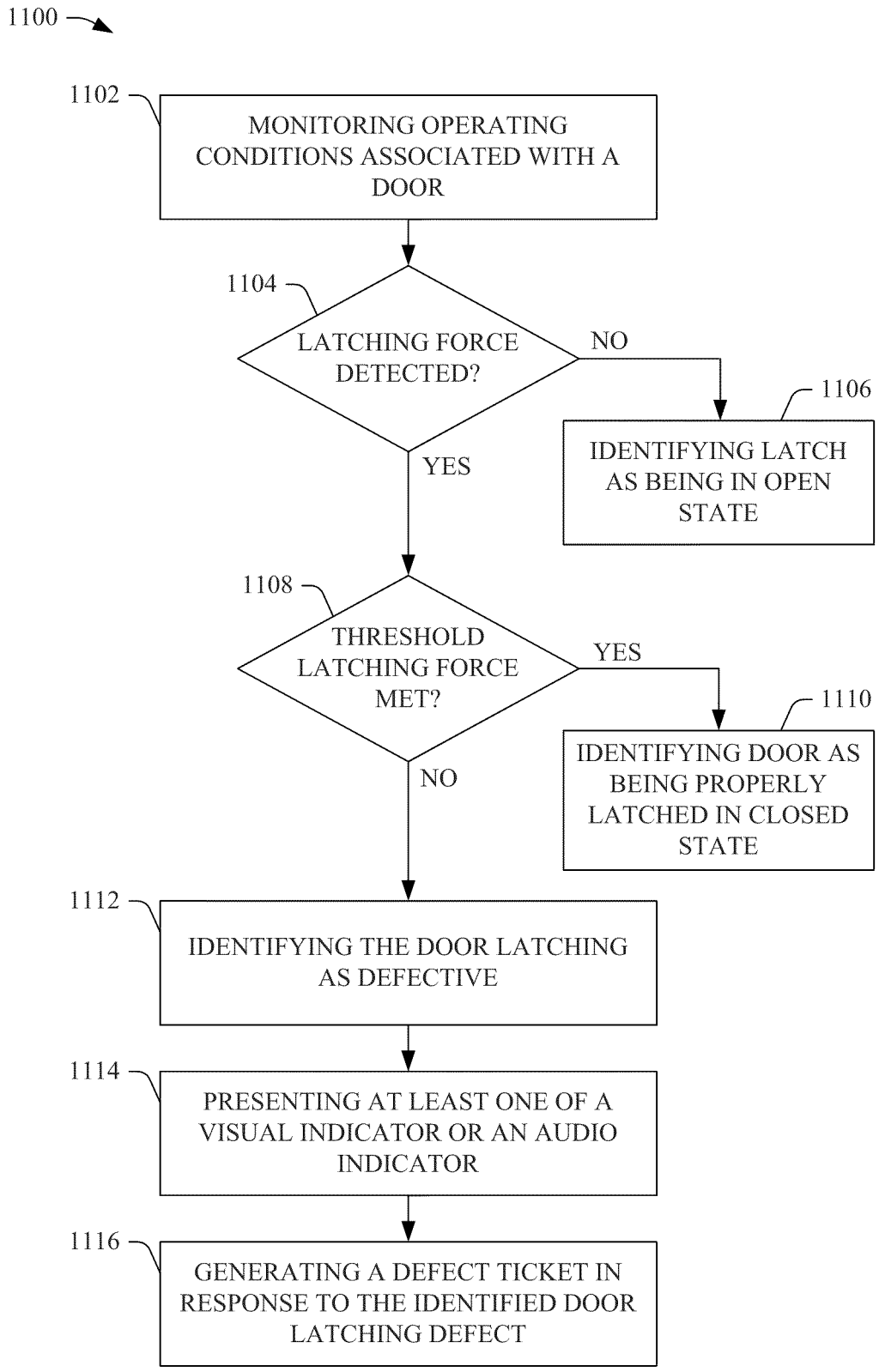
FIG. 11 illustrates a flowchart of an example methodology that can monitor and detect operating conditions associated with a door in accordance with an aspect of the disclosed subject matter.

Turning to FIG. 11, depicted is an example methodology 1100 that can monitor and detect operating conditions associated with a door in accordance with an aspect of the disclosed subject matter. At 1102, operating conditions associated with a door can be monitored. In an aspect, a first bracket component can be attached to a door frame such that an overhang portion of the first bracket component can extend out beyond the door frame and into the doorway to act as a door stop and part of a door latch. The first bracket component can comprise a recessed area (e.g., formed of, or having attached thereto, a ferromagnetic material(s)) to form part of the door stop/door latching system. A second bracket component can be attached to the door, associated with the door frame, and can comprise an extended portion that can have a holder component (e.g., permanent magnet) wherein the extended portion, or at least the holder component, can have a desired size and shape to achieve a desired force profile. The recessed area (or another component formed thereon or attached thereto) can be attracted to the magnetic force produced by the holder component to facilitate latching the door. The second bracket component can be desirably adjusted and attached to the door so that there is a desired amount of overlap of the holder component on the recessed area (or another component attached thereto or formed thereon), and correspondingly, a desired amount of latching force applied by the holder component on the recessed area (or another component attached thereto or formed thereon), when the door is in the closed position, wherein the holder component can be in contact with the recessed area (or another component attached thereto or formed thereon) to latch the door closed. In another aspect, the recessed can have a sensor component (e.g., MBS) that can be attached thereto or inserted therein, and can sense whether the recessed area (or another component attached thereto or formed thereon) is magnetized or not, and/or an amount of latching force (e.g., magnetic force) applied to or experienced by the recessed area (or another component attached thereto or formed thereon) to facilitate determining whether the door is properly latched (e.g., whether the extended portion (with the holder component) is properly latched to the recessed area).

At 1104, a determination can be made regarding whether a latching force is detected. In an aspect, the sensor component can detect whether there is a latching force being applied to the recessed area (or another component attached thereto or formed thereon) by the holder component. For instance, the sensor component can detect whether the recessed area (and/or another component formed thereon or attached thereto) is magnetized or not magnetized.

If it is determined that there is no latching force detected, at 1106, the door latch associated with the door can be identified as being in an open state. If no latching force is detected by the sensor component, the sensor component can transmit an open or unlatched signal to the remote operation system and/or another component), and the remote operation system and/or another component (e.g., local operation system or door status interface) associated with the sensor component can identify the door latch as being in the opened state, that is, can identify the holder component as not being latched to the recessed area.

If, at 1104, it is determined that there is a latching force detected, at 1108, a determination can be made regarding whether the latching force meets a predefined minimum threshold latching force level. In an aspect, the sensor component can measure or identify the amount of latching force being applied to the recessed area (or another component attached thereto or formed thereon) by the holder component or can provide information that can facilitate measuring or identifying the amount of latching force being applied to the recessed area (or another component attached thereto or formed thereon) by the holder component, wherein the sensor component can transmit a signal or message comprising such information. The amount of latching force can be evaluated in relation to the predefined minimum threshold latching force level (e.g., compared to the predefined minimum threshold latching force level) to determine whether the amount of latching force is at or higher than the predefined minimum threshold latching force level, wherein a latching force amount that is at or greater than the predefined minimum threshold latching force level can indicate that the door latch is properly latched, and/or can thereby indicate that the operation device associated with the door is in the desired predefined locational position for proper operation.

If it is determined that the amount of latching force at least meets the predefined minimum threshold latching force level, at 1110, the door latch can be identified as being properly latched. As desired, the associated operation device can perform any desired operations (e.g., when the operation device is a lock component, the lock pin can be inserted in the hole in the lock receptacle to lock the door).

If, at 1108, it is determined that the amount of latching force is below the predefined minimum threshold latching force level, at 1112, the door latching can be identified as defective. At 1114, at least one of a visual indicator or an audio indicator can be presented. In an aspect, a visual indicator or an audio indicator, which indicates that the door latch is defective can be presented locally via an interface(s) associated with the door (e.g., at or near the location of the door and/or associated defined physical area) and/or remotely via an interface(s) associated with the remote operation system. At 1116, a defect ticket can be generated in response to the identified door latching defect. In an aspect, a defect ticket relating to and identifying the defect in the door latching can be generated and, for example, can be provided to a maintenance person so that the maintenance person can examine and/or repair the door latch (e.g., adjust the position of the extended portion in relation to the holder component, replace a component of the door stop/door latch system, etc.).

For purposes of simplicity of explanation, methodologies that can be implemented in accordance with the disclosed subject matter were shown and described as a series of blocks. However, it is to be understood and appreciated that the disclosed subject matter is not limited by the order of the blocks, as some blocks can occur in different orders and/or concurrently with other blocks from what is depicted and described herein. Moreover, not all illustrated blocks can be required to implement the methodologies described hereinafter. Additionally, it should be further appreciated that the methodologies, or at least portions thereof, disclosed throughout this specification are capable of being stored on an article of manufacture to facilitate transporting and transferring such methodologies to computers. The term article of manufacture, as used, can encompass a computer program accessible from any computer-readable device, carrier, or media.

Figure 12:
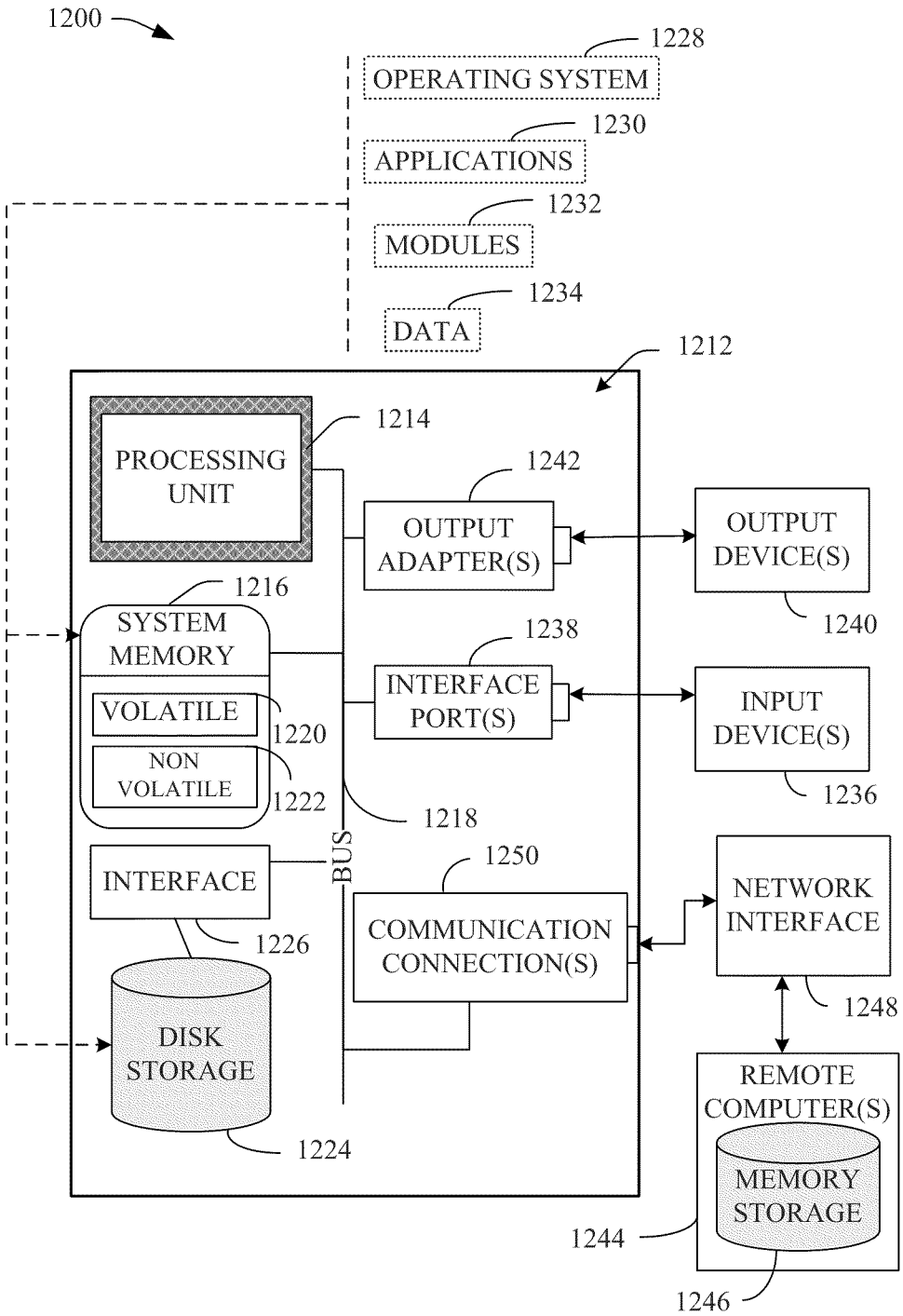
FIG. 12 is a schematic block diagram illustrating a suitable operating environment.
Figure 13:
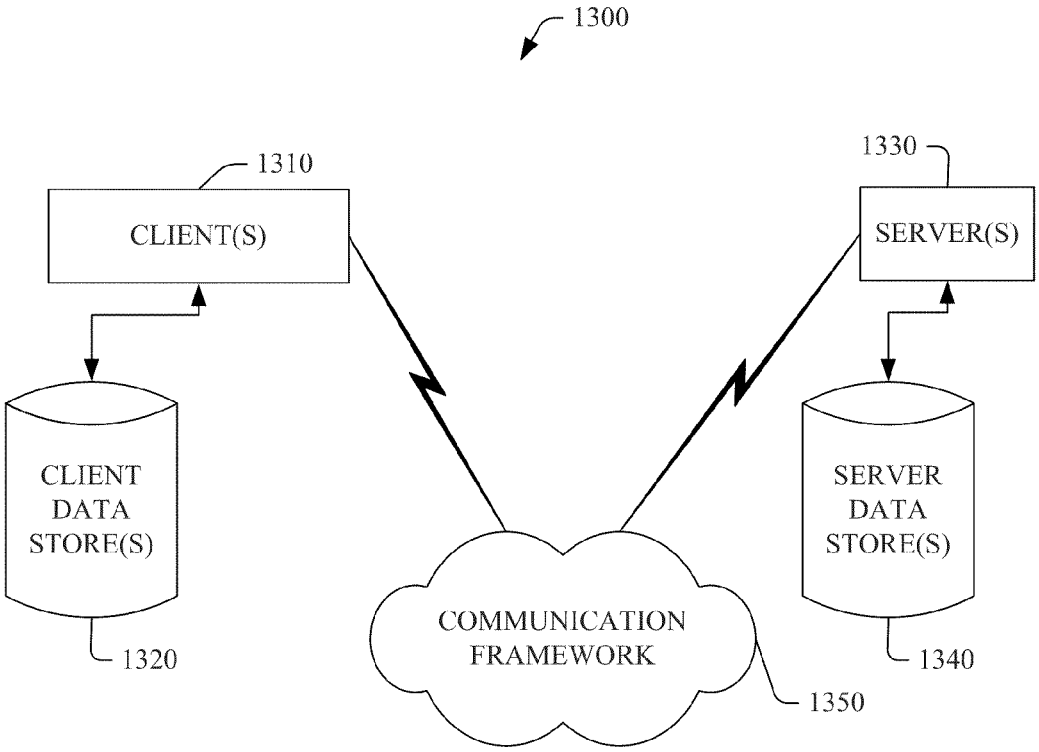
FIG. 13 is a schematic block diagram of a sample-computing environment.

In order to provide a context for the various aspects of the disclosed subject matter, FIGS. 12 and 13 as well as the following discussion are intended to provide a brief, general description of a suitable environment in which the various aspects of the disclosed subject matter can or may be implemented. While the subject matter has been described above in the general context of computer-executable instructions of a computer program that runs on a computer and/or computers, those skilled in the art will recognize that the subject innovation also may be implemented in combination with other program modules. Generally, program modules include routines, programs, components, data structures, etc. that perform particular tasks and/or implement particular abstract data types. Moreover, those skilled in the art will appreciate that the inventive methods may be practiced with other computer system configurations, including single-processor or multiprocessor computer systems, mini-computing devices, mainframe computers, as well as personal computers, handheld computing devices (e.g., personal digital assistant (PDA), phone, watch), microprocessor-based or programmable consumer or industrial electronics, and the like. The illustrated aspects may also be practiced in distributed computing environments where tasks are performed by remote processing devices that are linked through a communications network. However, some, if not all aspects of the claimed innovation can be practiced on stand-alone computers. In a distributed computing environment, program modules may be located in both local and remote memory storage devices.

With reference to FIG. 12, a suitable environment 1200 for implementing various aspects of the claimed subject matter includes a computer 1212. The computer 1212 includes a processing unit 1214, a system memory 1216, and a system bus 1218. The system bus 1218 couples system components including, but not limited to, the system memory 1216 to the processing unit 1214. The processing unit 1214 can be any of various available processors. Dual microprocessors and other multiprocessor architectures also can be employed as the processing unit 1214.

The system bus 1218 can be any of several types of bus structure(s) including the memory bus or memory controller, a peripheral bus or external bus, and/or a local bus using any variety of available bus architectures including, but not limited to, Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Card Bus, Universal Serial Bus (USB), Advanced Graphics Port (AGP), Personal Computer Memory Card International Association bus (PCMCIA), Firewire (IEEE 1394), and Small Computer Systems Interface (SCSI).

The system memory 1216 includes volatile memory 1220 and nonvolatile memory 1222. The basic input/output system (BIOS), containing the basic routines to transfer information between elements within the computer 1212, such as during start-up, is stored in nonvolatile memory 1222. By way of illustration, and not limitation, nonvolatile memory 1222 can include read only memory (ROM), programmable ROM (PROM), electrically programmable ROM (EPROM), electrically erasable programmable ROM (EEPROM), or flash memory. Volatile memory 1220 includes random access memory (RAM), which acts as external cache memory. By way of illustration and not limitation, RAM is available in many forms such as static RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), Rambus direct RAM (RDRAM), direct Rambus dynamic RAM (DRDRAM), and Rambus dynamic RAM (RDRAM).

Computer 1212 also includes removable/non-removable, volatile/nonvolatile computer storage media. FIG. 12 illustrates, for example, a disk storage 1224. Disk storage 1224 includes, but is not limited to, devices like a magnetic disk drive, floppy disk drive, tape drive, Jaz drive, Zip drive, LS-100 drive, flash memory card, or memory stick. In addition, disk storage 1224 can include storage media separately or in combination with other storage media including, but not limited to, an optical disk drive such as a compact disk ROM device (CD-ROM), CD recordable drive (CD-R Drive), CD rewritable drive (CD-RW Drive) or a digital versatile disk ROM drive (DVD-ROM). To facilitate connection of the disk storage devices 1224 to the system bus 1218, a removable or non-removable interface is typically used, such as interface 1226.

It is to be appreciated that FIG. 12 describes software that acts as an intermediary between users and the basic computer resources described in the suitable operating environment 1200. Such software includes an operating system 1228. Operating system 1228, which can be stored on disk storage 1224, acts to control and allocate resources of the computer system 1212. System applications 1230 take advantage of the management of resources by operating system 1228 through program modules 1232 and program data 1234 stored either in system memory 1216 or on disk storage 1224. It is to be appreciated that the claimed subject matter can be implemented with various operating systems or combinations of operating systems.

A user enters commands or information into the computer 1212 through input device(s) 1236. Input devices 1236 include, but are not limited to, a pointing device such as a mouse, trackball, stylus, touch pad, keyboard, microphone, joystick, game pad, satellite dish, scanner, TV tuner card, digital camera, digital video camera, web camera, and the like. These and other input devices connect to the processing unit 1214 through the system bus 1218 via interface port(s) 1238. Interface port(s) 1238 include, for example, a serial port, a parallel port, a game port, and a universal serial bus (USB). Output device(s) 1240 use some of the same type of ports as input device(s) 1236. Thus, for example, a USB port may be used to provide input to computer 1212, and to output information from computer 1212 to an output device 1240. Output adapter 1242 is provided to illustrate that there are some output devices 1240 like monitors, speakers, and printers, among other output devices 1240, which require special adapters. The output adapters 1242 include, by way of illustration and not limitation, video and sound cards that provide a means of connection between the output device 1240 and the system bus 1218. It should be noted that other devices and/or systems of devices provide both input and output capabilities such as remote computer(s) 1244.

Computer 1212 can operate in a networked environment using logical connections to one or more remote computers, such as remote computer(s) 1244. The remote computer(s) 1244 can be a personal computer, a server, a router, a network PC, a workstation, a microprocessor based appliance, a peer device or other common network node and the like, and typically includes many or all of the elements described relative to computer 1212. For purposes of brevity, only a memory storage device 1246 is illustrated with remote computer(s) 1244. Remote computer(s) 1244 is logically connected to computer 1212 through a network interface 1248 and then physically connected via communication connection 1250. Network interface 1248 encompasses wire and/or wireless communication networks such as local-area networks (LAN) and wide-area networks (WAN). LAN technologies include Fiber Distributed Data Interface (FDDI), Copper Distributed Data Interface (CDDI), Ethernet, Token Ring and the like. WAN technologies include, but are not limited to, point-to-point links, circuit switching networks like Integrated Services Digital Networks (ISDN) and variations thereon, packet switching networks, and Digital Subscriber Lines (DSL).

Communication connection(s) 1250 refers to the hardware/software employed to connect the network interface 1248 to the bus 1218. While communication connection 1250 is shown for illustrative clarity inside computer 1212, it can also be external to computer 1212. The hardware/software necessary for connection to the network interface 1248 includes, for exemplary purposes only, internal and external technologies such as, modems including regular telephone grade modems, cable modems and DSL modems, ISDN adapters, and Ethernet cards.

FIG. 13 is a schematic block diagram of a sample-computing environment 1300 with which the subject innovation can interact. The system 1300 includes one or more client(s) 1310. The client(s) 1310 can be hardware and/or software (e.g., threads, processes, computing devices). The system 1300 also includes one or more server(s) 1330. Thus, system 1300 can correspond to a two-tier client server model or a multi-tier model (e.g., client, middle tier server, data server), amongst other models. The server(s) 1330 can also be hardware and/or software (e.g., threads, processes, computing devices). The servers 1330 can house threads to perform transformations by employing the subject innovation, for example. One possible communication between a client 1310 and a server 1330 may be in the form of a data packet transmitted between two or more computer processes.

The system 1300 includes a communication framework 1350 that can be employed to facilitate communications between the client(s) 1310 and the server(s) 1330. The client(s) 1310 are operatively connected to one or more client data store(s) 1320 that can be employed to store information local to the client(s) 1310. Similarly, the server(s) 1330 are operatively connected to one or more server data store(s) 1340 that can be employed to store information local to the servers 1330.

Generally, program modules include routines, programs, components, data structures, etc., that perform particular tasks or implement particular abstract data types. Moreover, those skilled in the art will appreciate that the inventive methods can be practiced with other computer system configurations, including single-processor or multiprocessor computer systems, minicomputers, mainframe computers, as well as personal computers, hand-held computing devices, microprocessor-based or programmable consumer electronics, and the like, each of which can be operatively coupled to one or more associated devices.

A computer typically includes a variety of computer-readable media. Computer-readable media can be any available media that can be accessed by the computer and includes both volatile and nonvolatile media, removable and non-removable media. By way of example, and not limitation, computer-readable media can comprise computer storage media and communication media. Computer storage media includes volatile and nonvolatile, removable and non-removable media implemented in any method or technology for storage of information such as computer-readable instructions, data structures, program modules or other data. Computer storage media includes, but is not limited to, RAM, ROM, EEPROM, flash memory or other memory technology, CD-ROM; digital versatile disk (DVD) or other optical disk storage, magnetic cassettes, magnetic tape, magnetic disk storage or other magnetic storage devices, or any other medium which can be used to store the desired information and which can be accessed by the computer.

Communication media typically embody computer-readable instructions, data structures, program modules or other data in a modulated data signal such as a carrier wave or other transport mechanism, and includes any information delivery media. By way of example, and not limitation, communication media include wired media such as a wired network or direct-wired connection, and wireless media such as acoustic, RF, infrared and other wireless media. Combinations of the any of the above should also be included within the scope of computer-readable media.

The aforementioned systems have been described with respect to interaction among several components. It should be appreciated that such systems and components can include those components or sub-components specified therein, some of the specified components or sub-components, and/or additional components. Sub-components can also be implemented as components communicatively coupled to other components rather than included within parent components. Additionally, it should be noted that one or more components could be combined into a single component providing aggregate functionality. The components could also interact with one or more other components not specifically described herein but known by those of skill in the art.

It is to be appreciated and understood that components (e.g., first bracket component, second bracket component, extended portion, holder component, operation device, etc.), as described with regard to a particular system or methodology, can include the same or similar functionality as respective components (e.g., respectively named components) as described with regard to other systems or methodologies disclosed herein.

Furthermore, the disclosed subject matter can be implemented as a method, apparatus, or article of manufacture using standard programming and/or engineering techniques to produce software, firmware, hardware, or any combination thereof to control a computer to implement the disclosed subject matter. The term "article of manufacture" as used herein is intended to encompass a computer program accessible from any computer-readable device, carrier, or media. For example, computer readable media can include but are not limited to magnetic storage devices (e.g., hard disk, floppy disk, magnetic strips . . . ), optical disks (e.g., compact disk (CD), digital versatile disk (DVD) . . . ), smart cards, and flash memory devices (e.g., card, stick, key drive . . . ). Additionally it should be appreciated that a carrier wave can be employed to carry computer-readable electronic data such as those used in transmitting and receiving electronic mail or in accessing a network such as the Internet or a local area network (LAN). Of course, those skilled in the art will recognize many modifications can be made to this configuration without departing from the scope or spirit of the disclosed subject matter.

Some portions of the detailed description have been presented in terms of algorithms and/or symbolic representations of operations on data bits within a computer memory. These algorithmic descriptions and/or representations are the means employed by those cognizant in the art to most effectively convey the substance of their work to others equally skilled. An algorithm is here, generally, conceived to be a self-consistent sequence of acts leading to a desired result. The acts are those requiring physical manipulations of physical quantities. Typically, though not necessarily, these quantities take the form of electrical and/or magnetic signals capable of being stored, transferred, combined, compared, and/or otherwise manipulated.

It has proven convenient at times, principally for reasons of common usage, to refer to these signals as bits, values, elements, symbols, characters, terms, numbers, or the like. It should be borne in mind, however, that all of these and similar terms are to be associated with the appropriate physical quantities and are merely convenient labels applied to these quantities. Unless specifically stated otherwise as apparent from the foregoing discussion, it is appreciated that throughout the disclosed subject matter, discussions utilizing terms such as processing, computing, calculating, determining, and/or displaying, and the like, refer to the action and processes of computer systems, and/or similar consumer and/or industrial electronic devices and/or machines, that manipulate and/or transform data represented as physical (electrical and/or electronic) quantities within the computer's and/or machine's registers and memories into other data similarly represented as physical quantities within the machine and/or computer system memories or registers or other such information storage, transmission and/or display devices.

In the subject specification, terms such as "data store," "storage," and substantially any other information storage component relevant to operation and functionality of a component, refer to "memory components," or entities embodied in a "memory" or components comprising the memory. For example, information relevant to operation of various components described in the disclosed subject matter, and that can be stored in a memory, can comprise, but is not limited to comprising, information relating to operation of the lock component, programming information, information relating to authentication and authorization to access the lock component, etc. It will be appreciated that the memory components described herein can be either volatile memory or nonvolatile memory, or can include both volatile and nonvolatile memory. By way of illustration, and not limitation, nonvolatile memory can include read only memory (ROM), programmable ROM (PROM), electrically programmable ROM (EPROM), electrically erasable ROM (EEPROM), phase change memory (PCM), flash memory, or nonvolatile RAM (e.g., ferroelectric RAM (FeRAM). Volatile memory can include random access memory (RAM), which acts as external cache memory. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM). Additionally, the disclosed memory components of systems or methods herein are intended to comprise, without being limited to comprising, these and any other suitable types of memory.

Further, as used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

What has been described above includes examples of the subject specification. It is, of course, not possible to describe every conceivable combination of components or methodologies for purposes of describing the subject specification, but one of ordinary skill in the art can recognize that many further combinations and permutations of the subject specification are possible. Accordingly, the subject specification is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A system that facilitates latching a door, comprising:

a first bracket component that is configured to have an overhang portion that extends into a doorway when the first bracket component is attached to a door frame and at least one recessed area formed in the overhang portion; and a second bracket component that is configured to be attached to the door and to have an extended portion that extends out from a main portion of the second bracket component, and is further configured to be adjustable in position in relation to the first bracket component to correspondingly adjust an amount of overlap of the extended portion over the at least one recessed area when in a latched state to adjust an amount of force applied to one of the extended portion or the at least one recessed area by a holder component attached to an other of the extended portion or the at least one recessed area in accordance with a force profile associated with at least one of the extended portion, the at least one recessed area, or the holder component.

2. The system of claim 1, wherein the force profile is based at least in part on at least one of shape of at least one of the extended portion, the at least one recessed area, or the holder component; size of at least one of the extended portion, the at least one recessed area, or the holder component; or one or more materials of which at least one of the extended portion, the at least one recessed area, or the holder component is formed.

3. The system of claim 2, wherein the one of the extended portion or the at least one recessed area is configured to have a rectangular or square shape that results in the force profile being linear or substantially linear such that adjustment of the amount of overlap of the one of the extended portion or the at least one recessed area on the holder component results in a corresponding linear or substantially linear change in the amount of the force applied to the one of the extended portion or the at least one recessed area.

4. The system of claim 2, wherein the one of the extended portion or the at least one recessed area is configured to have at least one of a rounded shape, a triangular shape, or other non-rectangular or non-square shape that results in the force profile being non-linear such that adjustment of the amount of overlap of the one of the extended portion or the at least one recessed area on the holder component results in a corresponding non-linear change in the amount of the force applied to the one of the extended portion or the at least one recessed area.

5. The system of claim 1, further comprising:

the holder component that is configured to be inserted or attached to the other of the extended portion or the at least one recessed area, wherein the holder component is further configured to contain at least one of a permanent magnet that produces an attractive magnetic force, at least one vacuum cup that produces a suction force when in contact with the at least one of the extended portion or the at least one recessed area, a Velcro liner that provides a holding force when in contact with a Velcro receptor associated with the at least one of the extended portion or the at least one recessed area, or an electromagnetic component that can generate and apply an attractive electromagnetic force.

6. The system of claim 1, further comprising:

at least one operation device that is configured to be attached to at least one of the first bracket component or the second bracket component and further configured to perform at least one operation, wherein the at least one operation device comprising at least one of a lock, a sensor, or a switch.

7. The system of claim 6, wherein the at least one operation device is the lock comprising a solenoid actuator, which is associated with a lock pin and is attached to the first bracket component, and a lock receptacle, which is attached to the second bracket component, wherein position of the lock pin and position of a hole in the lock receptacle are aligned such that the lock pin is able to engage the hole to lock the door when the door is latched in a predefined locational position.

8. The system of claim 1, further comprising:

a sensor component that is configured to monitor and detect at least one of a magnetic state of the one of the extended portion or the at least one recessed area, or the amount of the force applied to the one of the extended portion or the at least one recessed area, and is further configured to transmit a signal indicating at least one of the one of the extended portion or the at least one recessed area is in an unmagnetized state, the one of the extended portion or the at least one recessed area is in a magnetized state, or the amount of force applied to the one of the extended portion or the at least one recessed area, to facilitate determining whether the one of the extended portion or the at least one recessed area is properly latched to the holder component.

9. The system of claim 8, further comprising:

a remote operation system that is configured to identify at least one of the whether the one of the extended portion or the at least one recessed area is in the unmagnetized state, whether the one of the extended portion or the at least one recessed area is in the magnetized state, or the amount of the force applied to the one of the extended portion or the at least one recessed area by the holder component.

10. The system of claim 9, wherein the remote operation system is further configured to generate and transmit at least one of a maintenance ticket that indicates there is a defect in the latching of the door or a defect indicator to facilitate presentation of at least one of a visual indicator or an audio indicator that indicates there is a defect in the latching of the door.

11. A method for latching a door, comprising:

controlling an amount of overlap of an extended portion of a second bracket component on a surface of a recessed area associated with a first bracket component to facilitate obtaining a specified amount of latching force between one of the extended portion or the recessed area, and a holder component associated with an other of the extended portion or the recessed area to hold the door associated with the extended portion in a predefined locational position in relation to an associated door frame when the door is in a closed position; and applying the specified amount of latching force to the one of the extended portion or the recessed area to hold the one of the extended portion or the recessed area, and the door in the predefined locational position when the extended portion is placed in the closed position.

12. The method of claim 11, further comprising:

forming at least one of the extended portion, the recessed area, or the holder component in a respective specified shape to obtain a desired force profile to facilitate obtaining the specified amount of latching force.

13. The method of claim 12, wherein the respective specified shape is one of a rectangular shape or a square shape that results in the force profile being linear or substantially linear such that adjustment of the amount of overlap of the one of the extended portion or the recessed area on the holder component results in a corresponding linear or substantially linear change in amount of latching force applied to the one of the extended portion or the recessed area.

14. The method of claim 12, wherein the respective specified shape is at least one of a rounded shape, a triangular shape, or another non-rectangular or non-square shape that results in the force profile being non-linear such that adjustment of the amount of overlap of the one of the extended portion or the recessed area on the holder component results in a corresponding non-linear change in amount of latching force applied to the one of the extended portion or the recessed area.

15. The method of claim 11, further comprising:

adjusting the second bracket component in relation to at least one of the first bracket component or a portion of an operation device attached to the second bracket component to facilitate the controlling of the amount of overlap of the one of the extended portion or the recessed area on a surface of the holder component.

16. The method of claim 11, further comprising:

monitoring at least one of a magnetized state of the one of the extended portion or the recessed area, or an amount of latching force applied to the one of the extended portion or the recessed area;

detecting the at least one of the magnetized state of the one of the extended portion or the recessed area, or the amount of latching force applied to the one of the extended portion or the recessed area; and at least one of:

transmitting a proper-latch signal when the amount of latching force is at or above a predefined minimum threshold latching force level, transmitting a defective-latch signal when the amount of latching force is below the predefined minimum threshold latching force level, but is above a predefined threshold force level indicative of the door being in an open position, or transmitting an unlatched signal when the amount of latching force is at or below the predefined threshold force level indicative of the door being in the open position.

17. The method of claim 11, further comprising:

stopping the door using an overhang portion of the first bracket component, when the extended portion and the door associated therewith are moved from an open position to the closed position, in response to the extended portion coming into contact with the overhang portion, wherein the overhang portion extends outward into a doorway associated with the door frame; and absorbing at least a portion of impact associated with the extended portion coming into contact with the overhang portion to facilitate reducing an amount of impact on an operation device attached to the first bracket component.

* * * * *